US008836735B2

(12) United States Patent
Fujiwara et al.

(10) Patent No.: US 8,836,735 B2
(45) Date of Patent: Sep. 16, 2014

(54) ILLUMINATION DEVICE, DISPLAY DEVICE, DATA GENERATION METHOD, DATA GENERATION PROGRAM AND RECORDING MEDIUM

(75) Inventors: Kohji Fujiwara, Osaka (JP); Takayuki Murai, Osaka (JP); Hideki Ichioka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 427 days.

(21) Appl. No.: 13/138,158

(22) PCT Filed: Nov. 5, 2009

(86) PCT No.: PCT/JP2009/068867
§ 371 (c)(1),
(2), (4) Date: Jul. 14, 2011

(87) PCT Pub. No.: WO2010/092713
PCT Pub. Date: Aug. 19, 2010

(65) Prior Publication Data

US 2011/0273488 A1 Nov. 10, 2011

(30) Foreign Application Priority Data

Feb. 16, 2009 (JP) ..... 2009-033146

(51) Int. Cl.
*G09G 5/10* (2006.01)
*G09G 3/34* (2006.01)
*G09G 3/36* (2006.01)

(52) U.S. Cl.
CPC ..... *G09G 3/3413* (2013.01); *G09G 2330/021* (2013.01); *G09G 2320/0242* (2013.01); *G09G 2320/041* (2013.01); *G09G 2320/0646* (2013.01); *G09G 3/342* (2013.01); *G09G 3/3611* (2013.01)
USPC ..... 345/690; 345/156; 345/88; 345/89

(58) Field of Classification Search
CPC ..... G09G 2330/021; G09G 3/3413; G09G 2320/0242; G09G 2320/041; G09G 2320/0646; G09G 3/342; G09G 3/3611
USPC ..... 345/88, 120, 690, 156, 89; 348/302
See application file for complete search history.

(56) References Cited

U.S. PATENT DOCUMENTS

| | | | | |
|---|---|---|---|---|
| 2004/0070565 | A1* | 4/2004 | Nayar et al. | 345/156 |
| 2005/0264702 | A1 | 12/2005 | Yoshii | |
| 2006/0214904 | A1 | 9/2006 | Kimura et al. | |
| 2007/0152934 | A1* | 7/2007 | Maeda | 345/92 |
| 2007/0223908 | A1* | 9/2007 | Sakamoto | 396/234 |
| 2008/0111903 | A1* | 5/2008 | Makino et al. | 348/302 |
| 2008/0278432 | A1 | 11/2008 | Ohshima | |
| 2008/0297463 | A1 | 12/2008 | Tsuru et al. | |
| 2008/0304286 | A1* | 12/2008 | Iwasaki | 362/612 |
| 2011/0241978 | A1* | 10/2011 | Fergason | 345/88 |

FOREIGN PATENT DOCUMENTS

| | | | |
|---|---|---|---|
| JP | 200601136 | A | 1/2006 |
| JP | 2007034251 | A | 2/2007 |
| JP | 2008176211 | A | 7/2008 |
| JP | 2008304908 | A | 12/2008 |

* cited by examiner

*Primary Examiner* — Thuy Pardo
(74) *Attorney, Agent, or Firm* — Harness, Dickey & Pierce, P.L.C.

(57) ABSTRACT

Under management by a main microcomputer, an LED controller performs, along at least two directions within a plane of planar light formed by LEDs arranged in a matrix, brightness correction processing for adjusting the distribution of brightness of the planar light on light source color video signals to convert them into light source color video signals.

6 Claims, 18 Drawing Sheets

Background Art

ILLUMINATION DEVICE, DISPLAY DEVICE, DATA GENERATION METHOD, DATA GENERATION PROGRAM AND RECORDING MEDIUM

TECHNICAL FIELD

The present invention relates to an illumination device such as a backlight unit and a display device (such as a liquid crystal display device) incorporating an illumination device. The present invention also relates to a method of generating light amount adjustment data for controlling the light source of an illumination device, a program for generating the light amount adjustment data and a storage medium for storing the data generation program.

BACKGROUND ART

In a backlight unit 169 in which fluorescent tubes 191 as shown in FIG. 20 are arranged throughout and which emits planar light, it is easy to change the distribution of brightness in a direction p in which the fluorescent tubes are aligned. For example, in the aligned fluorescent tubes 191, when the brightness of the fluorescent tubes 191 around the ends is set lower than that of the fluorescent tubes 191 around the center, a brightness distribution diagram (brightness distribution diagram specified by a brightness level L and the p direction) as show in FIG. 20 is obtained.

In the brightness distribution described above, the brightness of the planar light around the center that is relatively easily recognized by a visually recognizing person is high, and the brightness of the planar light in the perimeter thereof is low. However, in a human visual characteristic, uneven brightness of the planar light in the perimeter and with a low brightness, in particular, is not perceived. Hence, in the backlight unit 169 described above, part of the fluorescent tubes 191 is lower in brightness than the other fluorescent tubes 191, with the result that the power consumption is reduced.

However, in the backlight unit 169, since the distribution of brightness in a direction q in which the fluorescent tubes 191 extend cannot be changed, the power consumption is not sufficiently reduced. There has recently been a backlight unit in which LEDs (light emitting diodes) are arranged throughout in a matrix (for example, see patent document 1). In a liquid crystal display device incorporating such a backlight unit, planar light is partly controlled based on the result of analysis of data on an image displayed on a liquid crystal display panel.

This technology is called local dimming; only a part of planar light corresponding to a part of a display image on the liquid crystal display panel that has a relatively high brightness has a high brightness. Hence, this technology is effective for reducing the power consumption of a backlight, and therefore the power consumption of a liquid crystal display device.

RELATED ART DOCUMENT

Patent Document

Patent document 1: JP-A-2007-34251

DISCLOSURE OF THE INVENTION

Problems to be Solved by the Invention

However, since, in the local dimming, it is necessary to carefully analyze image data, a great burden is imposed on control performed by a control unit (unit composed of a microcomputer and the like) incorporated in a device. Hence, in a backlight unit (and therefore a liquid crystal display device) employing the local dimming, it is complicated to control planar light.

The present invention is designed to overcome the foregoing problem. An object of the present invention is to provide an illumination device or the like that minimises a burden imposed on control performed by a control unit and that can simultaneously reduce the power consumption.

Means for Solving the Problem

An illumination device includes: a plurality of light sources that are arranged in a plane and that emit light according to light amount adjustment data to form planar light; and a control unit that performs correction processing on light source control data based on image data to generate the light amount adjustment data. In the illumination device, the control unit performs brightness correction processing for adjusting distribution of brightness of the planar light on the light source control data along at least two directions within a plane of the planar light so as to generate the light amount adjustment data.

In this way, since the control unit changes the brightness of the light sources based on each of the directions, for example, as compared with a case where the brightness of the light sources is changed based on the result of analysis of the image data corresponding to each of the light sources, a burden imposed on the control is reduced. Moreover, since the brightness correction processing is performed along at least two directions within the plane of the planar light, the brightness correction processing is two-dimensionally performed on the planar light. Hence, the shape of the brightness distribution of the planar light greatly varies as compared with, for example, planar light on which the brightness correction processing is one-dimensionally performed (along only one direction).

Consequently, the illumination device can generate the planar light having the shape of the brightness distribution corresponding to the human visual characteristic. In other words, the illumination device can generate the planar light that prevents a human from feeling insufficient brightness without a relatively large amount of power being consumed One example thereof is an illumination device in which the brightness correction processing is performed in each of the directions such that a brightness around both ends of the direction is lower than a brightness around the center thereof.

In the illumination device described above, the brightness around the center of the planar light is little changed even after the brightness correction processing but the brightness in the outer edge of the planar light, that is, in the regions other than the vicinity of the center, on which the brightness correction processing has been performed, is lower than the brightness before the brightness correction processing. Humans are unlikely to feel that the planar light with such brightness distribution has relatively insufficient brightness (are unlikely to feel that the planar light includes uneven brightness). Moreover, as the brightness in the outer edge of the planar light is reduced, the power consumption is reduced. In other words, the illumination device can provide high-quality planar light, and can simultaneously reduce the power consumption.

The control unit preferably changes the brightness correction processing according to a specific parameter. For example, the specific parameter may be a display mode for the image data. The specific parameter may be a brightness level for the image data. When a temperature measurement portion that measures the temperature of the light sources is included in the illumination device, the specific parameter may be the result of the measurement by the temperature measurement portion.

When the specific parameter is the brightness level for the image data or the result of the measurement by the temperature measurement portion, preferably, the levels of the brightness correction processing are stepwise set, and the control unit performs the brightness correction processing in a stepwise order of the levels.

In this way, for example, even when a certain type of brightness correction processing is so changed to another type of brightness correction processing as to maximize the difference between their levels, an intermediate level of brightness correction processing is present between the maximum level of brightness correction processing and the minimum level of brightness correction processing. Thus, the variation in the brightness of the planar light due to the change of the brightness correction processing becomes unnoticeable.

In the illumination device, each of the light sources includes a plurality of light emission chips and colors of light are mixed to generate white light, and the control unit may perform a different type of the brightness correction processing for each of the colors. Moreover, in the illumination, each of the light sources is a light source that emits light of a single color, and the control unit may perform the brightness correction processing corresponding to the single color.

According to the present invention, there is also provided a display device including: the illumination device described above; and a display panel that displays an image according to the image data.

According to the present invention, there is also provided a method of generating light amount adjustment data for controlling light emission by a plurality of light sources that are arranged in a plane within an illumination device to form planar light. The method will be described below.

Specifically, in the method of generating the data, when correction processing is performed on light source control data based on image data such that the light amount adjustment data is generated, brightness correction processing for adjusting distribution of brightness of the planar light is performed on the light source control data along at least two directions within a plane of the planar light such that the light amount adjustment data is generated.

According to the present invention, there is also provided a program for generating light amount adjustment data in an illumination device that includes: a plurality of light sources that are arranged in a plane and that emit light according to the light amount adjustment data to form planar light; and a control unit that performs correction processing on light source control data based on image data to generate the light amount adjustment data. The program will be described below.

Specifically, the program for generating the data instructs the control unit to perform brightness correction processing for adjusting distribution of brightness of the planar light on the light source control data along at least two directions within a plane of the planar light such that the light amount adjustment data is generated.

According to the present invention, there is also provided a computer readable recording medium in which the program for generating the data described above is recorded.

Advantages of the Invention

With the illumination device of the present invention, it is possible to change the distribution of brightness of planar light by performing brightness correction processing along at least two directions within a plane of the planar light. Hence, in the brightness correction processing, for example, image data on each of light sources that generate the planar light is not analyzed, and thus a burden imposed on control performed by a control unit is relatively lowered.

On the other hand, since the planar light undergoes change which cannot be produced by brightness correction processing that is performed along one direction within the plane of the planar light, the distribution of brightness relatively greatly varies. Thus, the illumination device can generate the planar light having the distribution of brightness that is suitable for the reduction of the power consumption.

BEST MODE FOR CARRYING OUT THE INVENTION

First Embodiment

An embodiment of the present invention will be described below with reference to accompanying drawings. For convenience, member symbols or the like may be omitted; in this case, other drawings should be referenced. For convenience, hatching may be performed even in a diagram other than a cross-sectional view. Values mentioned herein are only an example; the present invention is not limited to these values.

Figure 18:
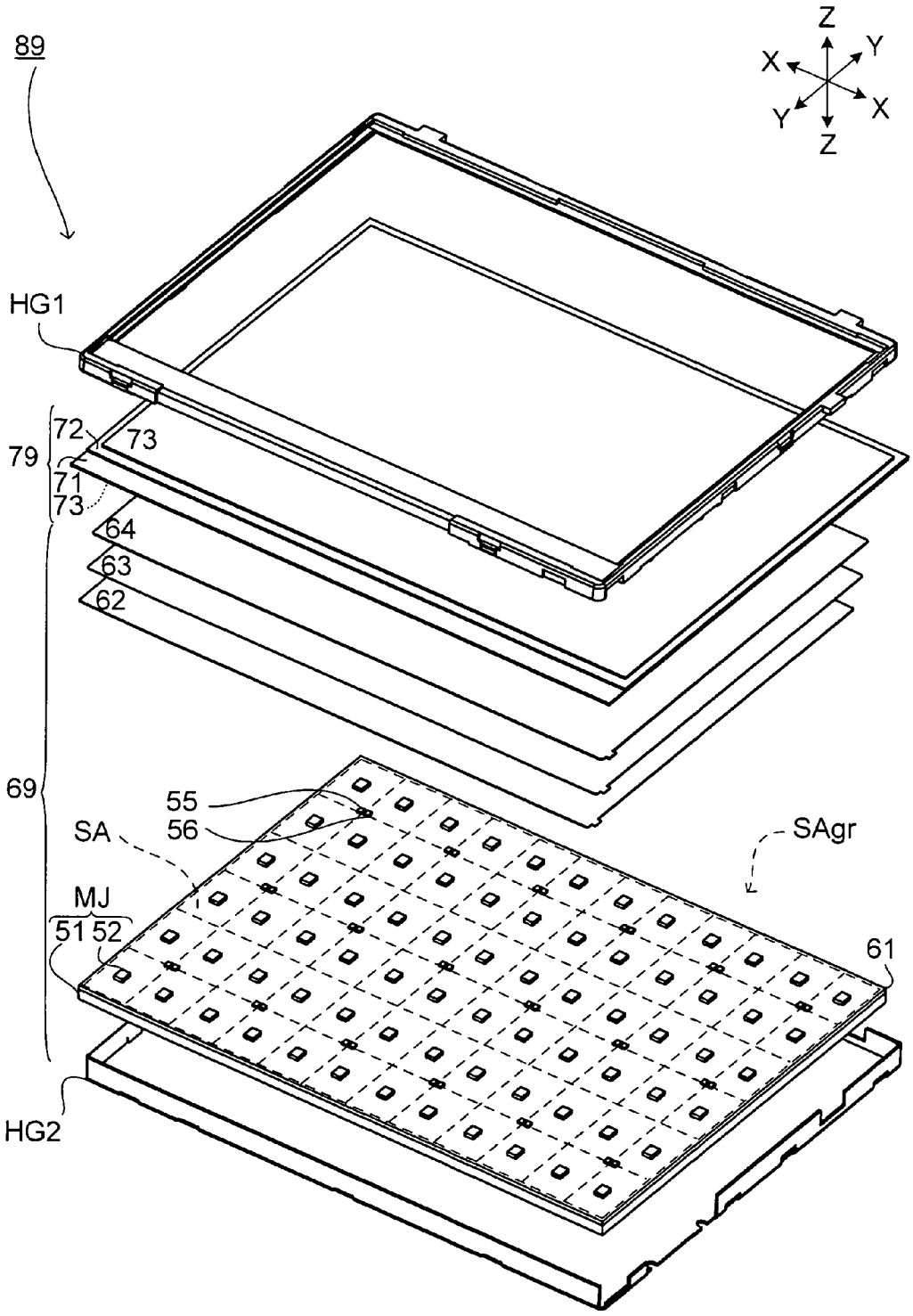
FIG. 18 An exploded perspective view showing the liquid crystal display device.

FIG. 18 is an exploded perspective view showing a liquid crystal display device (display device) 89. As shown in FIG. 18, the liquid crystal display device 89 includes a liquid crystal display panel (display panel) 79, a backlight unit (illumination unit) 69 and a housing HG (HG1 and HG2) that sandwiches them.

The liquid crystal display panel 79 employs an active matrix system. Hence, in the liquid crystal display panel 79, liquid crystal (not shown) is sandwiched between an active matrix substrate 71 to which active elements such as unillustrated TFTs (thin film transistors) are attached and an opposite substrate 72 opposite the active matrix substrate 71. In other words, the active matrix substrate 71 and the opposite substrate 72 are substrates for sandwiching the liquid crystal; they are formed of transparent glass or the like.

An unillustrated seal member is applied to the outside edges of the active matrix substrate 71 and the opposite substrate 72; the seal member seals in the liquid crystal. Polarization films 73 are attached such that the active matrix substrate 71 and the opposite substrate 72 are sandwiched therebetween.

Since the liquid crystal display panel 79 is a display panel that does not emit light, it receives light (backlight) from the backlight unit 69 to perform a display function. Hence, when the light from the backlight unit 69 can be evenly applied to the entire surface of the liquid crystal display panel 79, the display quality of the liquid crystal display panel 79 is enhanced.

The backlight unit 69 described above includes LED modules MJ, thermistors 55 (temperature measurement portions), photosensors 56, a reflective sheet 61, a diffusion sheet 62 and prism sheets 63 and 64.

The LED module MJ includes a mounting substrate 51 and an LED (light emitting diode) 52. In the mounting substrates 51, unillustrated electrodes are arranged in a plane (for example, in a matrix), and the LEDs (light sources or light emitting elements) 52 are mounted on the electrodes. The mounting substrates 51 supply current fed from an unillustrated power supply to the LEDs 52 through the electrodes.

The LEDs (light emitting element) 52 are spot light sources that receive current to emit light, and are arranged to correspond to the electrodes in the mounting surface of the mounting substrates 51 (the direction of the light emitting surface of the LEDs 52 is the same as the direction of the mounting surface over which the electrodes are arranged). Consequently, the LEDs 52 are arranged in a plane on the mounting surface of the mounting substrates 51 and generate planar light. As an example of the arrangement of the LEDs 52, a planar arrangement of the LEDs 52 both in a rectangle and in a matrix is taken; for convenience, the longitudinal direction of the rectangle is referred to as an X direction, and the lateral direction is referred to a Y direction.

Figure 19A:
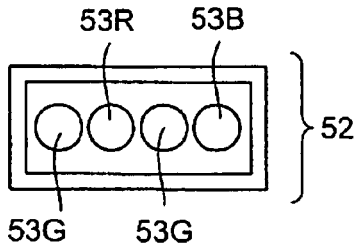
FIG. 19A A front view showing an LED incorporating a plurality of LED chips.

The type of LEDs 52 is not particularly limited. As an example, an LED 52 is taken in which, as shown in the front view of the LED 52 of FIG. 19A, a red light emission (R) LED chip 53R, two green light emission (G) LED chips 53G and a blue light emission (B) LED chip 53B are aligned and in which the colors of the light are mixed and thus white light is generated.

Figure 19B:
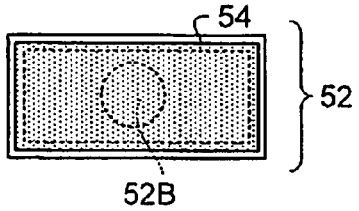
FIG. 19B A front view showing an LED incorporating an LED chip.
Figure 20:
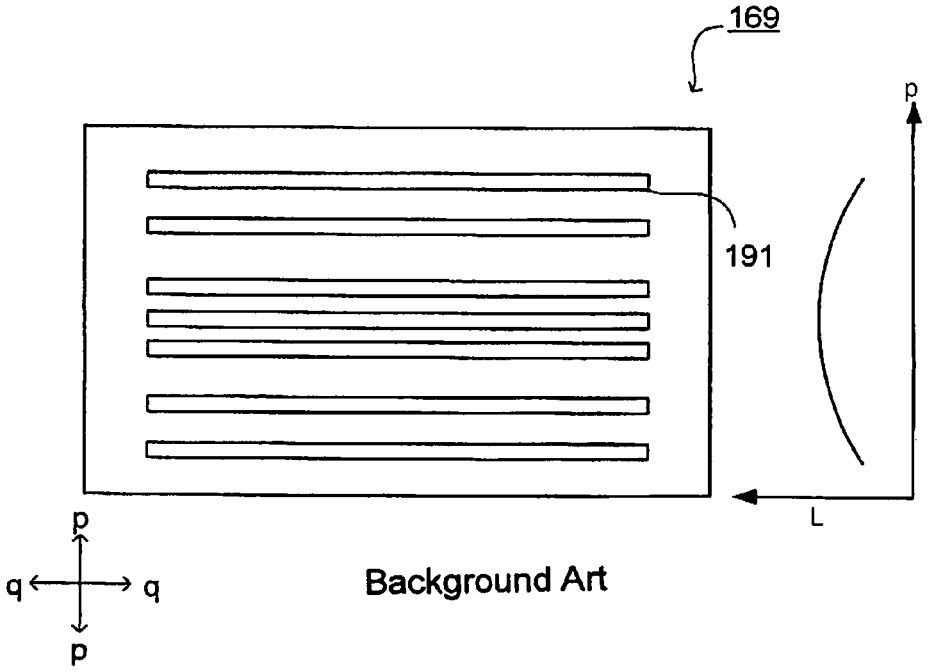
FIG. 20 A plan view showing a conventional backlight unit.

As another example, an LED 52 is taken in which, as shown in the front view of the LED 52 of FIG. 19B, a blue light emission LED chip 53B is combined with a fluorescent material 54 that receives the blue light to emit yellow light (in the following description, the LED 52 that mixes the colors of the light to emit white light is assumed to be used unless otherwise specified).

The light emission of the LED module MJ can be controlled on an individual LED 52 basis. Hence, the display region of the liquid crystal display panel 79 can be partly illuminated. In FIG. 18, an illumination region SA that can be controlled by each of the LEDs 52 is represented by broken lines. In other words, one compartment (one of a plurality of compartments arranged in a matrix) which is a region enclosed by the broken lines is the illumination region SA that can be controlled by each of the LEDs 52.

The thermistor 55 is a temperature sensor that measures the temperature of the LED 52; for each of four LEDs 52, one thermistor 55 is mounted on the mounting substrate 51 (specifically, on the mounting substrate 51, the thermistor 55 is mounted around the center of a region enclosed by four LEDs 52).

The photosensor 56 is a light measurement sensor that measures the brightness of the LED 52; as with the thermistor 55, for each of four LEDs 52, one photosensor 56 is mounted on the mounting substrate 51.

The reflective sheet 61 is a reflective member that is adhered to the mounting surface of the mounting substrates 51 so as to avoid the LEDs 52, the thermistors 55 and the photosensors 56; on the same side as the light emission side of the LEDs 52, the reflective sheet 61 has a reflective surface. Thus, even when part of light from the LEDs 52 travels toward the mounting surface of the mounting substrates 51, the light is reflected off the reflective surface of the reflective sheet 61.

The diffusion sheet 62 is positioned to cover the LEDs 52 arranged in a matrix, diffuses planar light formed with light from a plurality of LEDs 52 and thereby spreads it over the liquid crystal display panel 79 (the diffusion sheet 62 and the prism sheets 63 and 64 are also collectively referred to an optical sheet group (62 to 64)).

The prism sheets 63 and 64 have prism shapes, for example, within the surfaces of the sheets, and deflect light to change the radiation characteristic of the light; the prism sheets 63 and 64 are so positioned as to cover the diffusion sheet 62. Hence, the prism sheets 63 and 64 collect light traveling from the diffusion sheet 62, and thereby increase the brightness. The direction in which light collected by the prism sheet 63 is diverged intersects with the direction in which light collected by the prism sheet 64 is diverged.

In the backlight unit 69 described above, the planar light from the LEDs 52 that is increased in brightness by being passed through the optical sheet group (62 to 64) is emitted as backlight. Then, this backlight reaches the liquid crystal display panel 79, and an image is displayed on the liquid crystal display panel 79 with the backlight.

The housing HG will now be described. A front housing HG1 and a back housing HG2 constituting the housing HG are so fixed as to sandwich the backlight unit 69 described above and the liquid crystal display panel 79 covering the backlight unit 69 (the method of fixing them is not particularly limited). In other words, the backlight unit 69 and the liquid crystal display panel 79 are sandwiched between the front housing HG1 and the back housing HG2, with the result that the liquid crystal display device 89 is completed.

The back housing HG2 accommodates the LED modules MJ, the reflective sheet 61, the diffusion sheet 62 and the prism sheets 63 and 64 in this order such that they are stacked; the direction in which they are stacked is referred to as a Z direction (the X direction, the Y direction and the Z direction preferably intersect each other).

Since the backlight unit 69 in which a plurality of LEDs 52 are arranged in a matrix as described above can individually control light emitted by each of the LEDs 52, the display region of the liquid crystal display panel 79 can be partly illuminated. Hence, this type of backlight unit 69 can be considered to be the backlight unit 69 of an active area method.

Figure 1:
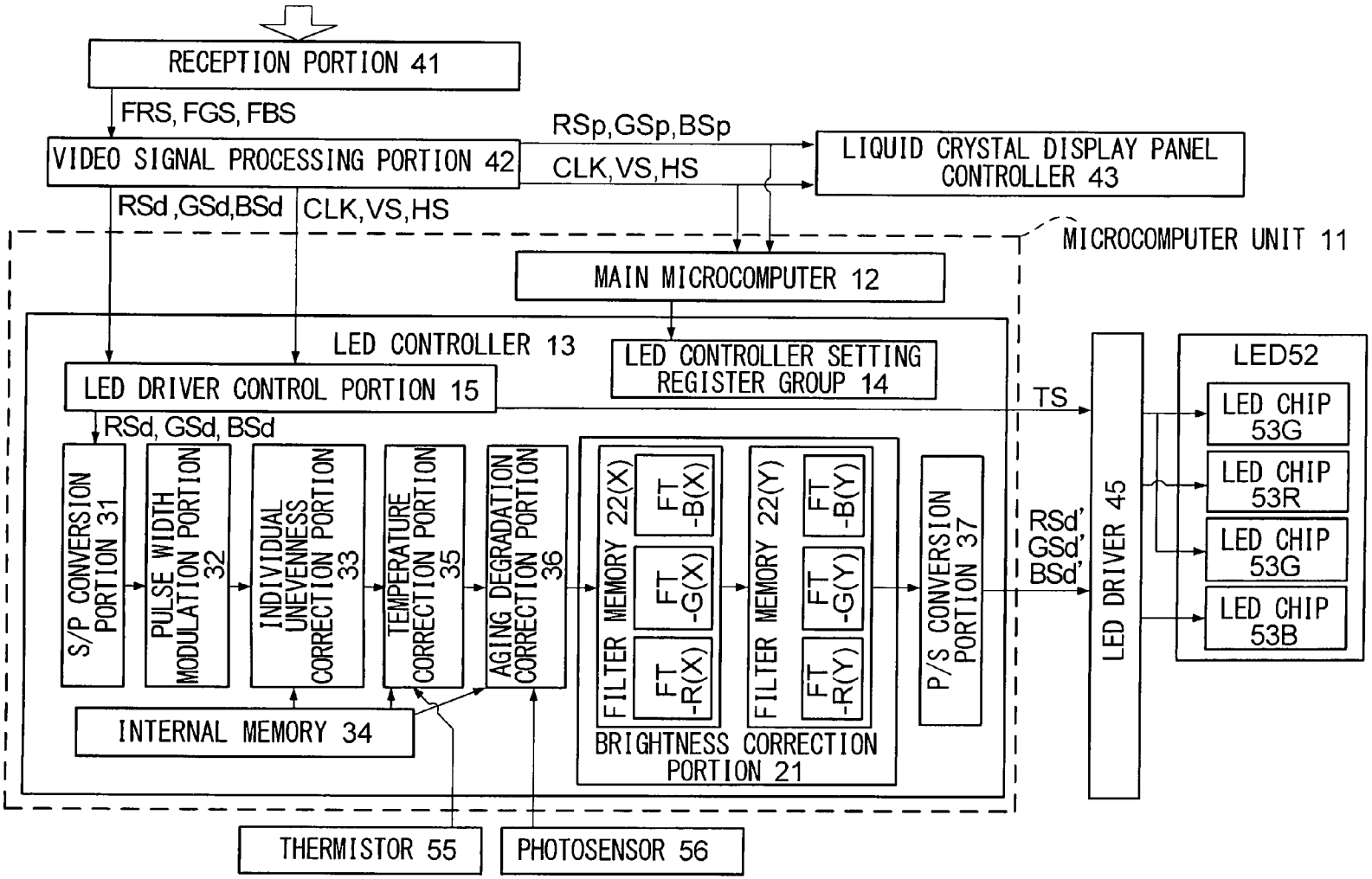
FIG. 1 A block diagram showing various members included in a liquid crystal display device.

The control of light emission performed by the backlight unit 69 of the active area method discussed above will now be described. FIG. 1 is a block diagram showing various members included in the liquid crystal display device 89 (the LED 52 shown in FIG. 1 is one of a plurality of LEDs 52).

As shown in FIG. 1, the liquid crystal display device 89 includes a reception portion 41, a video signal processing portion 42, a liquid crystal display panel controller 43, a main microcomputer 12, an LED controller 13, the thermistor 55, the photosensor 56, an LED driver 45 and the LED 52.

The reception portion 41 receives, for example, a video sound signal such as a television broadcast signal (see a white arrow) (a video signal included in the video sound signal will be mainly described below). Then, the reception portion 41 transmits the received video signal to the video signal processing portion 42.

For convenience, the video signal transmitted to the video signal processing portion 42 is assumed to be a basic video signal (image data); among color video signals included in the basic video signal, a signal indicating red is assumed to be a basic red video signal FRS, a signal indicating green is assumed to be a basic green video signal FGS and a signal indicating blue is assumed to be a basic blue video signal FBS.

The video signal processing portion 42 generates a processing video signal based on the received basic video signal (image data). Then, the video signal processing portion 42 transmits the processing video signal to the liquid crystal display panel controller 43 and the LED controller 13.

The processing video signals are, for example, a processing color video signal (a processing red video signal RS, a processing green video signal GS or a processing blue video signal BS) obtained by processing the basic color video signal (the basic red video signal FRS, the basic green video signal FGS, the basic blue video signal FBS or the like) and synchronization signals (a clock signal CLK, a vertical synchronization signal VS, a horizontal synchronization signal HS and the like) related to the processing color video signals.

The processing color video signal transmitted to the liquid crystal display panel controller 43 is different from the processing color video signal transmitted to the LED controller 13. Hence, in order to distinguish these processing color video signals, it is assumed that the processing color video signal transmitted to the liquid crystal display panel controller 43 is a panel processing red video signal RSp, a panel processing green video signal GSp or a panel processing blue video signal BSp.

On the other hand, it is assumed that the processing color video signal (light source control data) transmitted to the LED controller 13 is a light source red video signal RSd, a light source green video signal GSd or a light source blue video signal BSd (specifically, the light source color video signals (RSd, GSd and BSd) are corrected and are then transmitted to the LED driver 45; this will be described in detail later.)

Based on the panel processing red video signal RSp, the panel processing green video signal GSp, the panel processing blue video signal BSp and the synchronization signals related to these signals, the liquid crystal display panel controller 43 controls the pixels of the liquid crystal display panel 79.

The main microcomputer 12 comprehensively performs various types of control on the backlight unit 69, the liquid crystal display panel 79 and the like. The main microcomputer 12 and the LED controller 13 controlled by this main microcomputer 12 may be collectively referred to as a microcomputer unit 11.

Under management (control) by the main microcomputer 12, the LED controller 13 transmits various control signals to the LED driver 45. The LED controller 13 includes: an LED controller setting register group 14; an LED driver control portion 15; a serial parallel conversion portion (S/P conversion portion) 31; a pulse width modulation portion 32; an individual unevenness correction portion 33; an internal memory 34; a temperature correction portion 35; an aging degradation correction portion 36; a brightness correction portion 21; and a parallel serial conversion portion (P/S conversion portion) 37.

The LED controller setting register group 14 temporarily holds various control signals from the main microcomputer 12. In other words, the main microcomputer 12 temporarily controls various members within the LED controller 13 through the LED controller setting register group 14.

The LED driver control portion 15 transmits, to the S/P conversion portion 31, the light source color video signals (RSd, GSd and BSd) from the video signal processing portion 42. The LED driver control portion 15 also generates, from the synchronization signals (the clock signal CLK, the vertical synchronization signal VS, the horizontal synchronization signal HS and the like), a lighting timing signal TS of the LED 52 (specifically, the LED chips 53), and transmits it to the LED driver 45.

The S/P conversion portion 31 converts, into parallel data, the light source color video signal that is transmitted from the LED driver control portion 15 as serial data.

The pulse width modulation portion 32 uses a pulse width modulation (PWM) method and thereby adjusts, based on the light source color video signal, the time during which the LED 52 emits light. A signal value used in such pulse width modulation is referred to as a PWM signal (PWM value). The pulse width modulation method is known; in the method, for example, one second is divided into 128 time intervals, and the length of time during which the LED emits light is changed in each of the time intervals (for example, the PWM values of 12 bits=0 to 4095 are used to change the time during which the LED emits light).

The individual unevenness correction portion 33 previously checks the performance of each of the LEDs 52, and performs correction to eliminate errors between individuals. For example, the brightness of the LED 52 is previously measured with a specific PWM value. Specifically, the specific PWM value corresponding to each of the LED chips 53 is corrected such that, in each of the LEDs 52, the red light emission LED chip 53R, the green light emission LED chips 53G and the blue light emission LED chip 53B are turned on and that white light having a desired color shade can be generated.

Then, a plurality of LEDs 52 are turned on, and PWM values corresponding to the individual LEDs 52 (individual LED chips 53R, 53G and 53B) are further corrected such that the uneven brightness of planar light is eliminated. Thus, individual differences (individual unevenness of brightness and therefore the uneven brightness of the planar light) between the LEDs 52 are corrected.

There are various methods for performing such correction processing; correction processing using a common lookup table (LUT) is employed. Specifically, the individual unevenness correction portion 33 uses a LUT for individual unevenness in the LEDs 52 stored in the internal memory 34, and thereby performs the correction processing.

The internal memory 34 stores, for example, the LUT for individual unevenness in the LEDs 52 as described above. The internal memory 34 also stores LUTs that are required by the temperature correction portion 35 and the aging degradation correction portion 36 at stages succeeding the stage of the individual unevenness correction portion 33.

The temperature correction portion 35 performs correction for the decrease in the brightness of the LED 52 due to a temperature rise resulting from the light emission of the LED 52. For example, the temperature correction portion 35 acquires temperature data on the LED 52 (specifically, the LED chips 53R, 53G and 53B) with the thermistor 55 once every second, acquires the LUT corresponding to the temperature data from the internal memory 34 and performs the correction processing (specifically, changes PWM values corresponding to the LED chips 53R, 53G and 53B) for reducing the uneven brightness of the planar light.

The aging degradation correction portion 36 performs correction for the decrease in the brightness of the LED 52 due to the aging degradation of the LED 52. For example, the aging degradation correction portion 36 acquires brightness data on the LED 52 (specifically, the LED chips 53R, 53G and 53B) with the photosensor 56 once every year, acquires the LUT corresponding to the brightness data from the internal memory 34 and performs the correction processing (specifically, changes PWM values corresponding to the LED chips 53R, 53G and 53B) for reducing the uneven brightness of the planar light.

Figure 2:
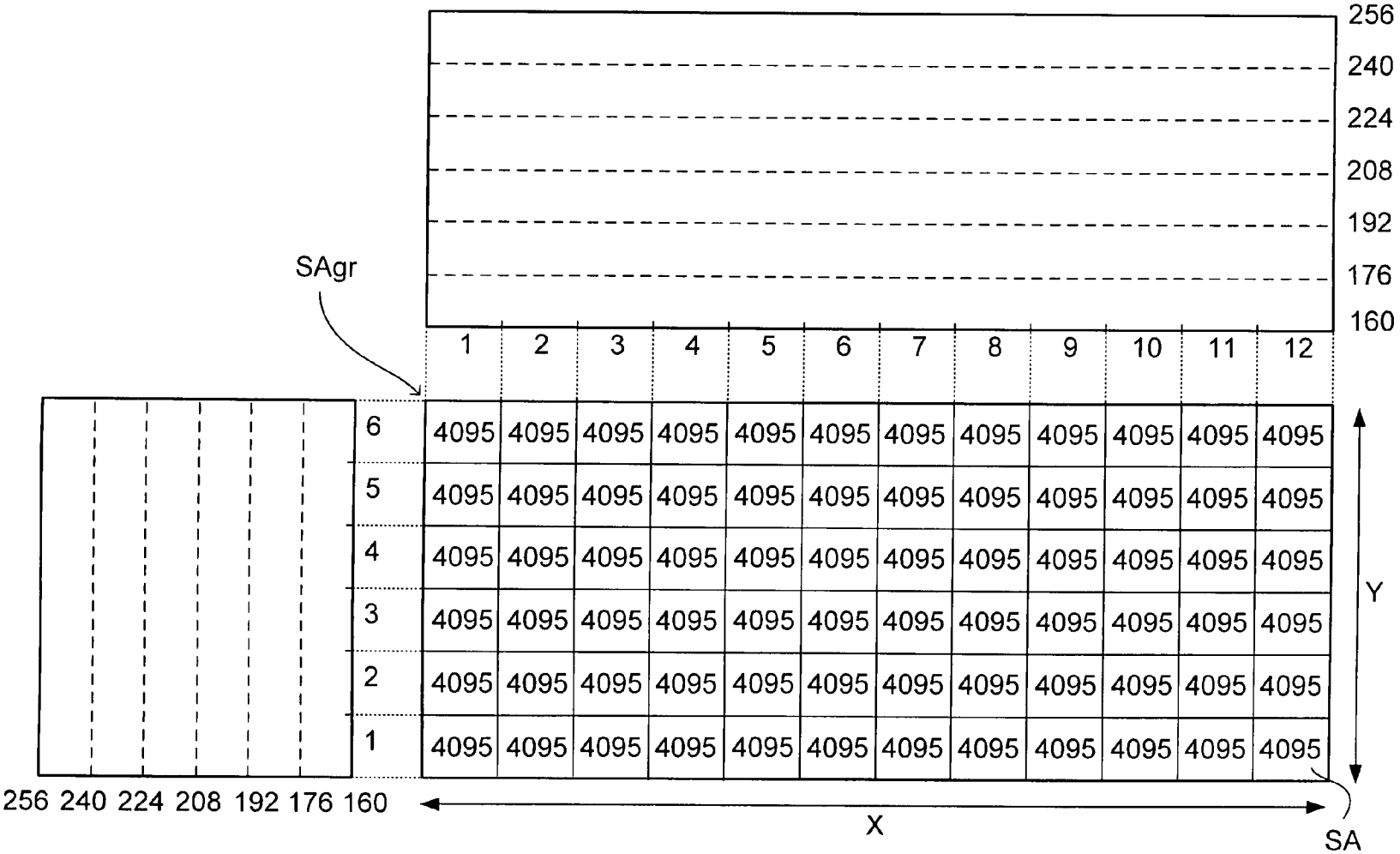
FIG. 2 An illustration diagram in which, when all LEDs arranged with 12 LEDs in an X direction and 6 LEDs in a Y direction emit light according to PWM values (for example, 4095), the PWM values are made to correspond to the illumination regions of the individual LEDs.

The brightness correction portion 21 corrects the distribution of brightness of the planar light in consideration of a human visual characteristic. The human visual characteristic will first be described. When, for example, all LEDs 52 that are arranged with 12 LEDs 52 in an X direction and 6 LEDs 52 in a Y direction emit light according to PWM values (for example, 4095), FIG. 2 is obtained by graphically expressing the PWM values and the illumination regions SA of the individual LEDs 52 (72 illumination regions SA (12×6=72) corresponding to the number of the LEDs 52) such that the PWM values correspond to the illumination regions SA.

Figure 3:
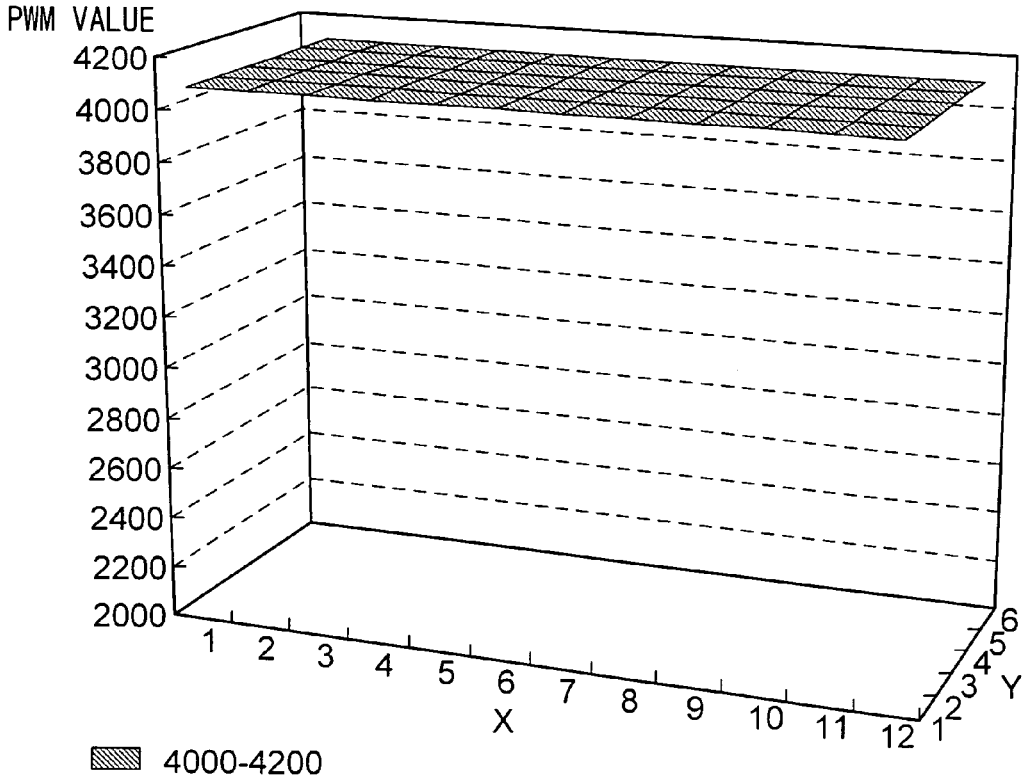
FIG. 3 A contour line diagram showing the illumination regions and the PWM values in a contour manner.

FIG. 3 is a diagram showing the illumination regions SA and the PWM values in a contour manner (although the PWM values shown in the figure is an example of the PWM values of one of the LED chips 53, for convenience, in the following description, the PWM values corresponding to the remaining LED chips 53 are assumed to be the same as the values shown in the figure).

When a part of the planar light of all connected illumination regions SA around the center is visually recognized by a human, and the brightness of the part around the center is sufficiently high, even if the brightness of the other regions is lower than that of the part around the center, uneven brightness of the planar light is not perceived by the human and the planar light is perceived by the human to have a constant brightness.

Hence, it is not necessary that, in order for the brightness of the planar light of an entire illumination region SAgr to be kept equal to or more than a predetermined value, the brightness of the illumination regions SA in the outer edge of the entire illumination region SAgr be equal to that of the illumination region SA around the center of the entire illumination region SAgr. Therefore, the brightness correction portion 21 performs correction processing (brightness correction processing) on the distribution of brightness such that the brightness of the illumination regions SA in the outer edge of the entire illumination region SAgr is lower than that of the illumination region SA around the center.

For example, the brightness correction portion 21 has filters FT (X, Y) formed by arranging coefficients (for example, values of 8 bits=0 to 255; filter values) necessary for changing the PWM values in an X direction and in a Y direction, and performs correction on the PWM values through a computation using the filters FT (X, Y) (since the brightness correction processing has not been performed on the PWM values shown in FIG. 2, plot points are not marked in two diagrams showing the filter values of the filters FT (X, Y) for the directions (the X direction and the Y direction).

Specifically, as shown in FIG. 1, the brightness correction portion 21 includes a filter memory 22 (X) that stores, for the X direction, a filter FT-R (X) corresponding to the red light emission LED chip 53R, a filter FT12-G (X) corresponding to the green light emission LED chips 53G and a filter FT12-B (X) corresponding to the blue light emission LED chip 53B.

The brightness correction portion 21 also includes a filter memory 22 (Y) that stores, for the Y direction, a filter FT-R (Y) corresponding to the red light emission LED chip 53R, a filter FT-G (Y) corresponding to the green light emission LED chips 53G and a filter FT-B (Y) corresponding to the blue light emission LED chip 53B.

The P/S conversion portion 37 converts, into serial data, the light source color video signal that is transmitted as parallel data and that has been subjected to various types of correction processing.

The LED driver 45 controls the turning on of the LED 52 based on the signals (the PWM signal and the timing signal) from the LED controller 13.

As described previously, the LED 52 includes one LED chip 53R, two LED chips 53G and one LED chip 53B. The turning on of these LED chips (light emission chips) 53 is controlled by the LED driver 45 with the pulse width modulation method.

The brightness correction processing that is performed on the light source color video signals (RSd, GSd and BSd) by the brightness correction portion 21 with the filters FT (X, Y) will now be described with reference to not only FIGS. 1 to 3 but also FIGS. 4 to 13. The light source color video signals (light amount adjustment data) on which the brightness correction processing has been performed is represented as a light source red video signal RSd', a light source green video signal GSd' and a light source blue video signal BSd' (that is, "'" is added to the signals on which the brightness correction processing has been performed).

In the description with reference to FIGS. 4 to 13, as in FIGS. 2 and 3, although the PWM values shown in the figures are an example of the PWM values of one of the LED chips 53, for convenience, the PWM values corresponding to the remaining LED chips 53 are assumed to be the same as the values shown in the figures.

Figure 4:
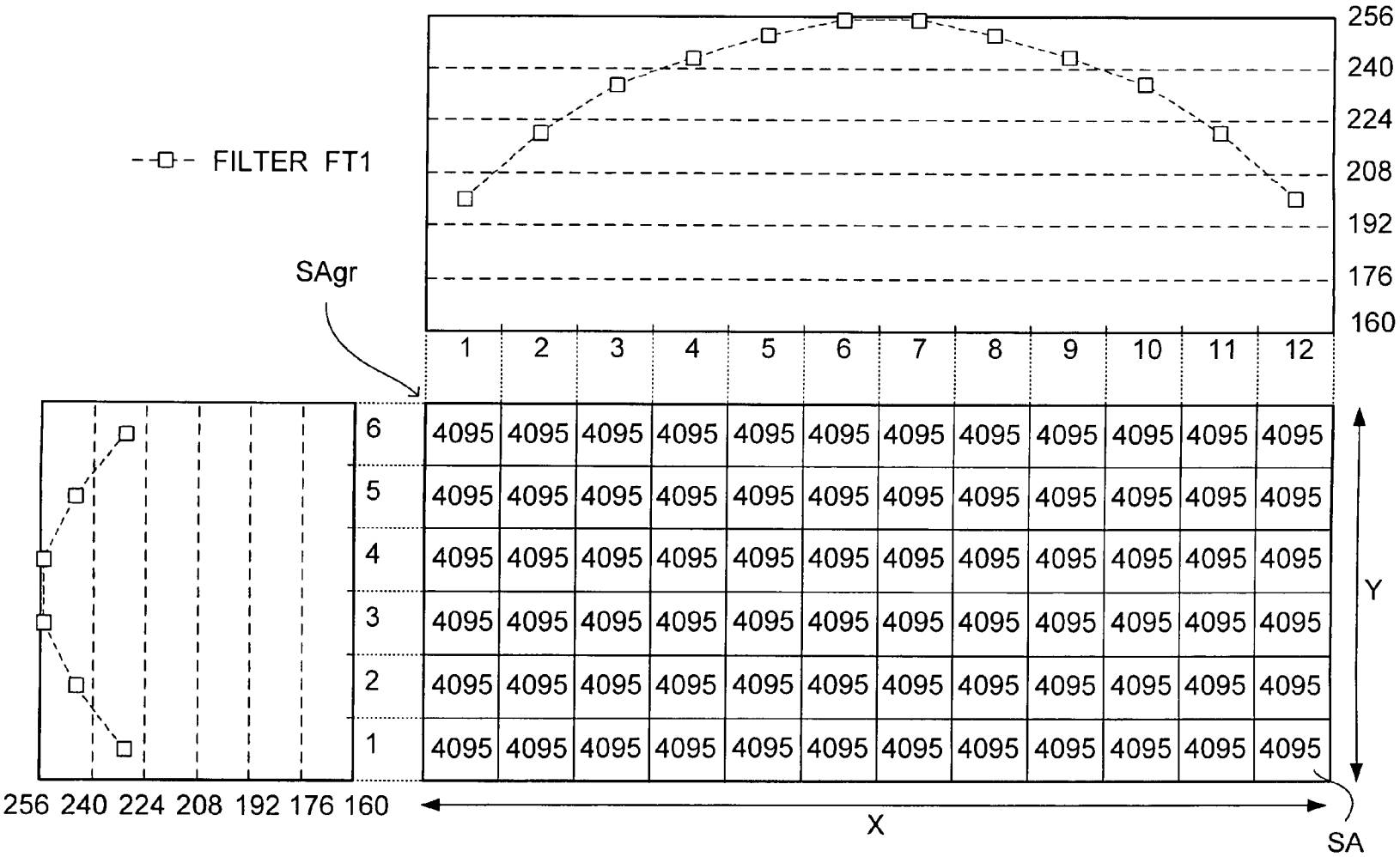
FIG. 4 An illustration diagram in which filter values of filters FT1 (X, Y) for the X direction and the Y direction are plotted according to the illumination regions such that the PWM values (for example, 4095) are made to correspond to the illumination regions of the individual LEDs.
Figure 5:
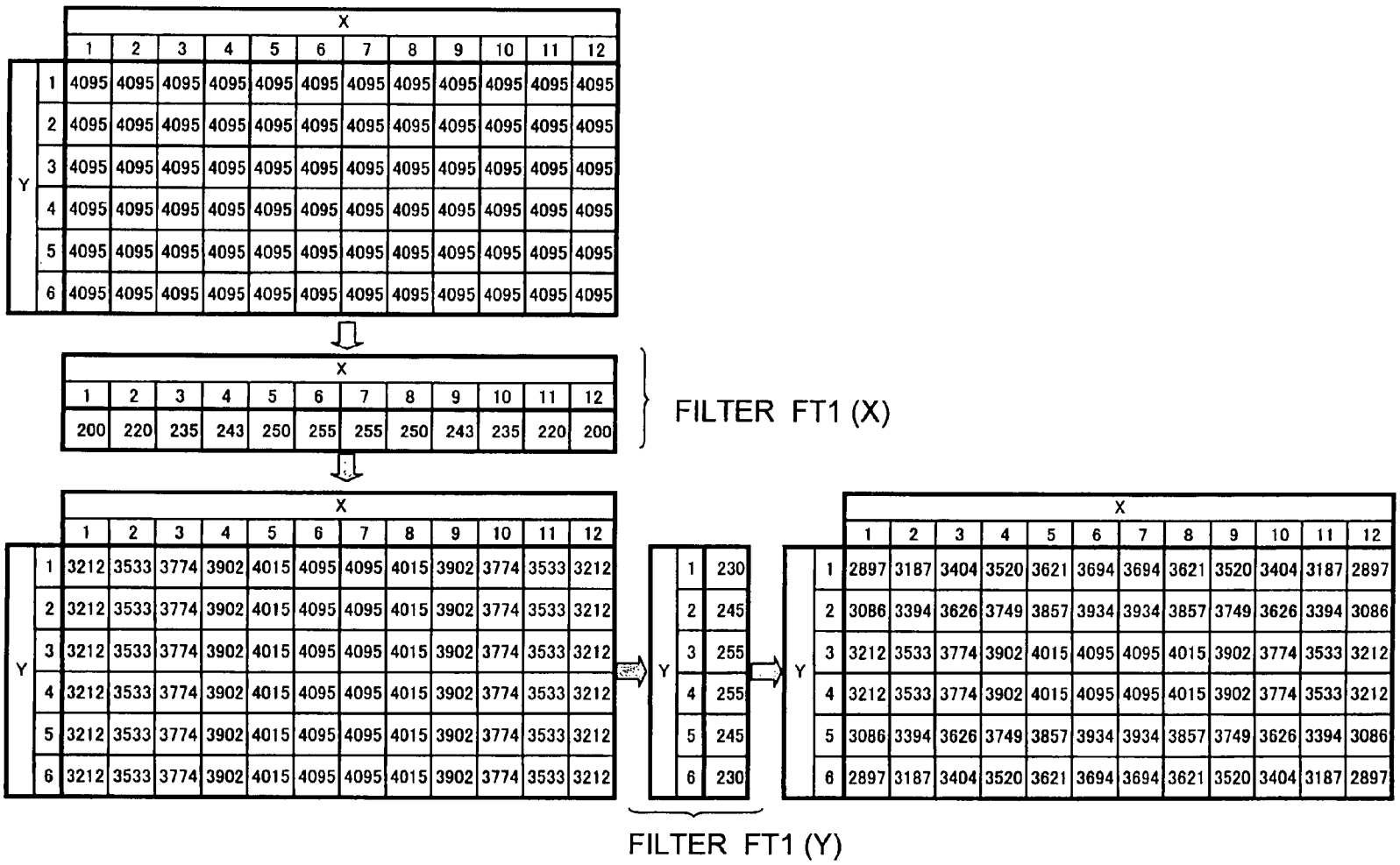
FIG. 5 An illustration diagram showing how the LEDs that emit light with the PWM value of 4095 are subjected to the brightness correction processing using the filter FT1 (X) for the X direction and then the LEDs are further subjected to the brightness correction processing using the filter FT1 (Y) for the Y direction.
Figure 6:
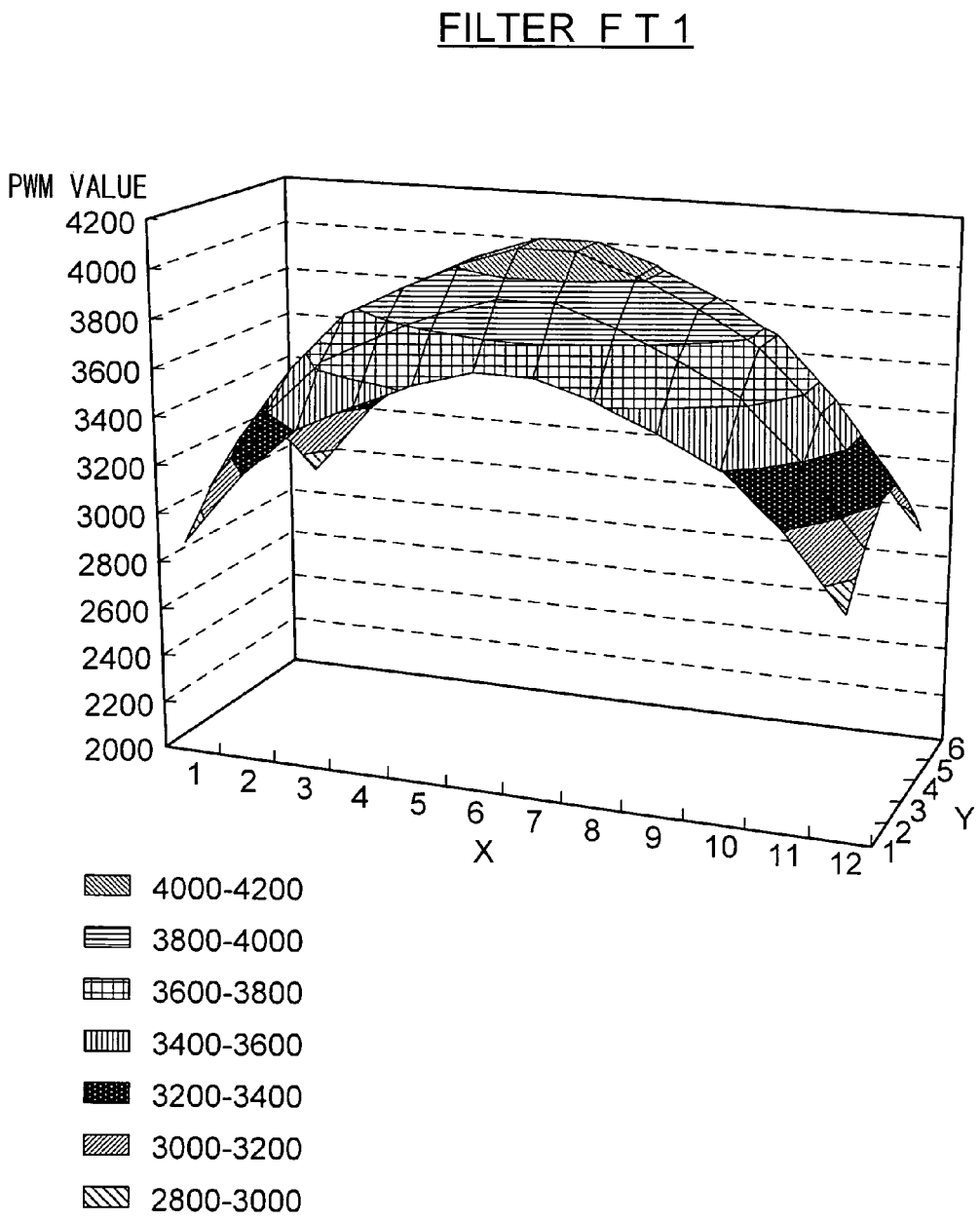
FIG. 6 A contour line diagram showing, in a contour manner, PWM values resulting from the brightness correction processing corresponding to the X direction and the Y direction using the filter FT1 (X, Y) and the illumination regions.

There are a plurality of types of filters FT (X, Y); FIGS. 4 to 6 relate to a filter FT1 (X, Y) [brightness correction (high) type], FIGS. 7 to 9 relate to a filter FT2 (X, Y) [brightness correction (medium) type] and FIGS. 10 to 12 relate to a filter FT3 (X, Y) [brightness correction (low) type].

Each of the filters FT1 (X, Y) to FT3 (X, Y) is present according to the LED chips 53R, 53G and 53B. For example, the filter FT1 (X, Y) corresponding to the LED chips 53 is represented as FT1 R-(X) or FT1 R-(Y).

Figure 7:
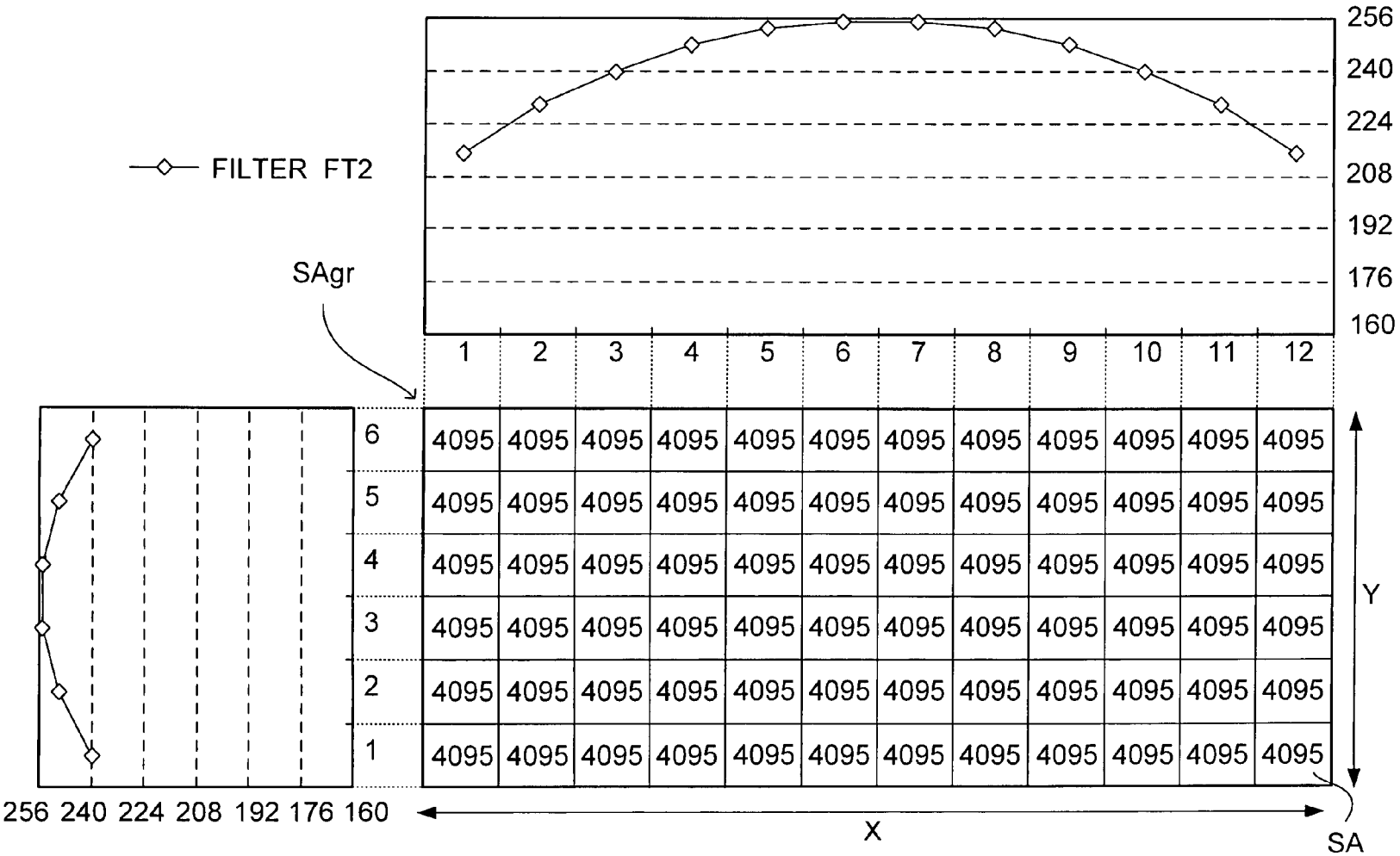
FIG. 7 An illustration diagram in which filter values of filters FT2 (X, Y) for the X direction and the Y direction are plotted according to the illumination regions such that the PWM values (for example, 4095) are made to correspond to the illumination regions of the individual LEDs.
Figure 10:
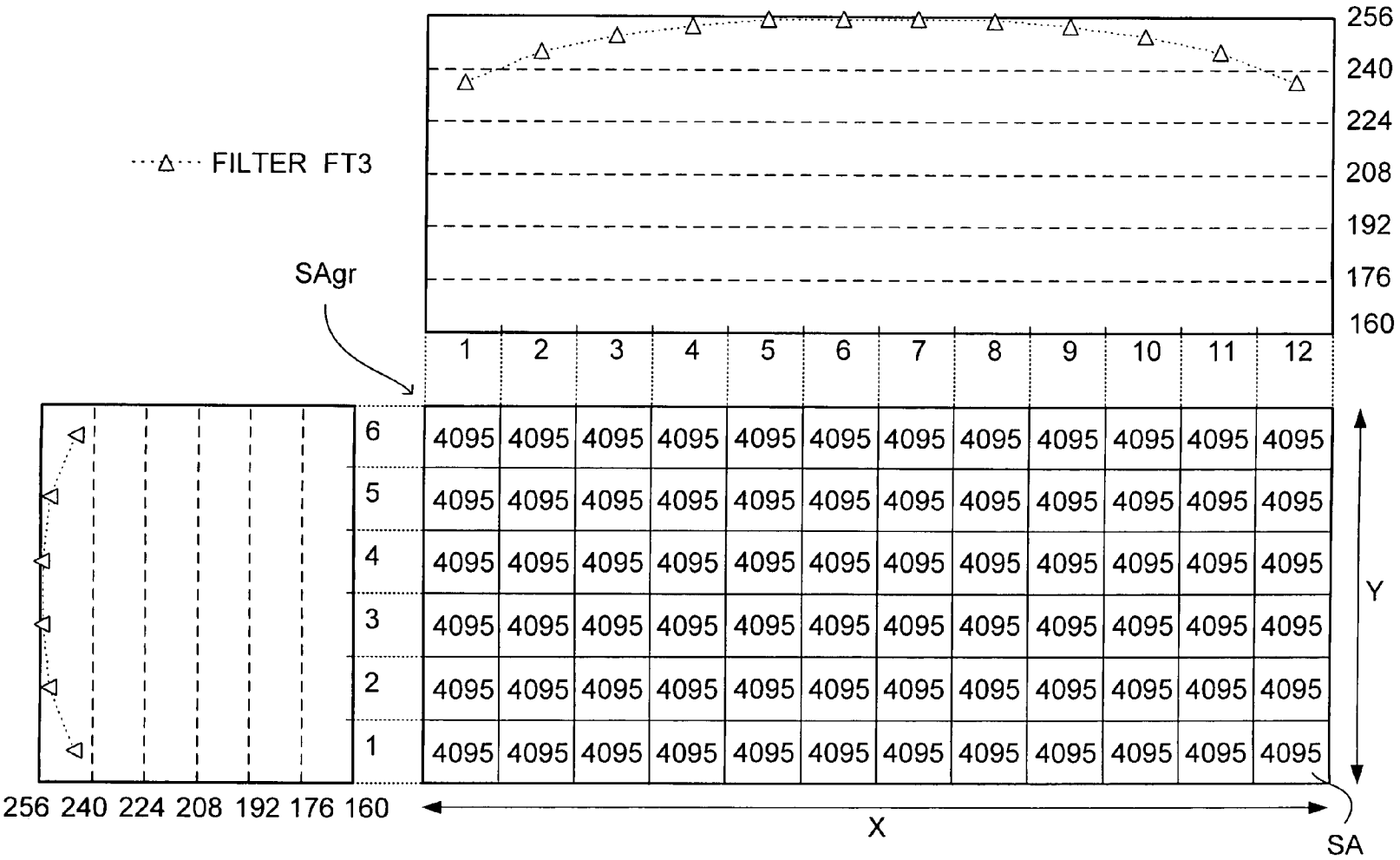
FIG. 10 An illustration diagram in which filter values of filters FT3 (X, Y) for the X direction and the Y direction are plotted according to the illumination regions such that the PWM values (for example, 4095) are made to correspond to the illumination regions of the individual LEDs.
Figure 13:
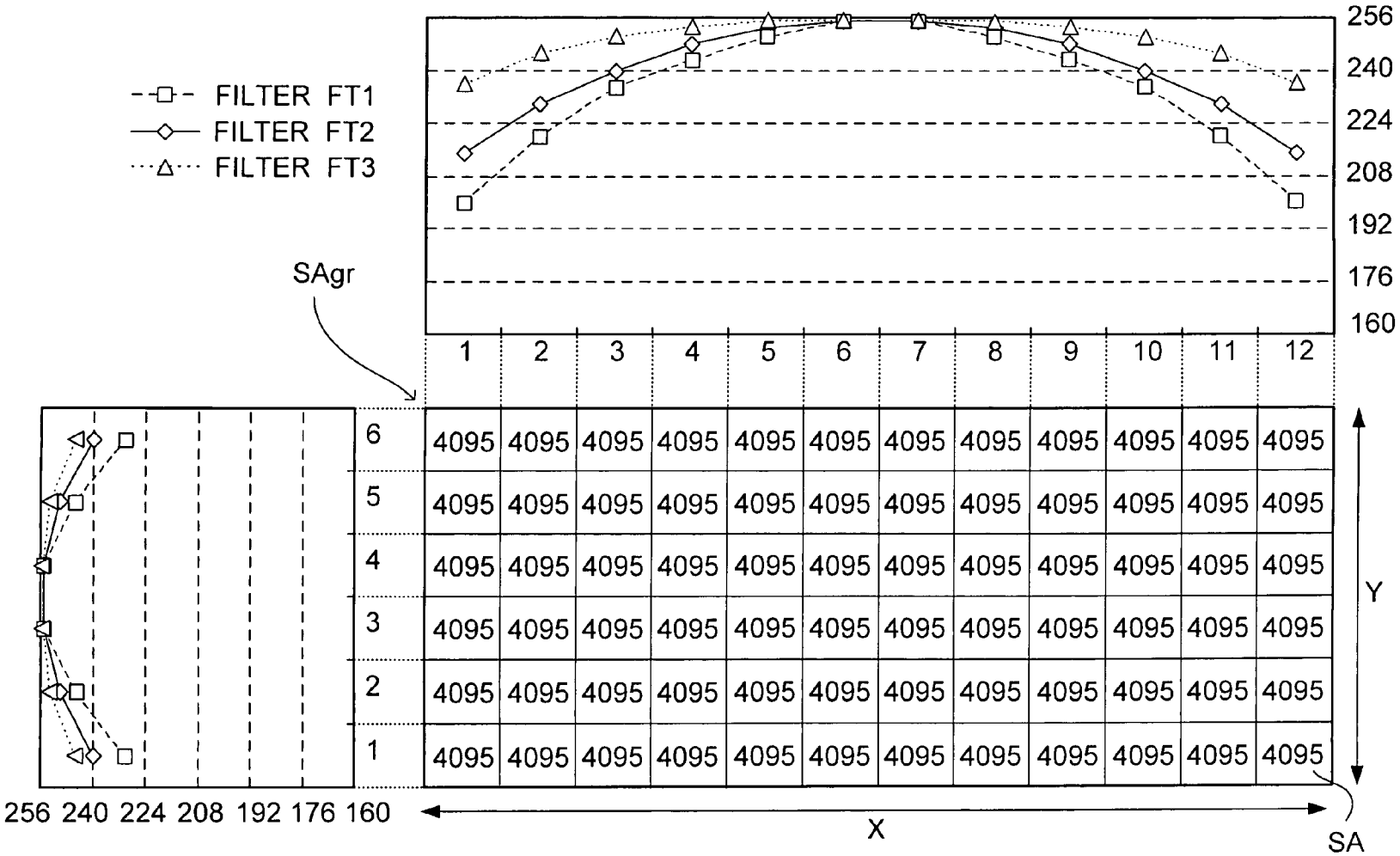
FIG. 13 An illustration diagram in which filter values of filters FT1 (X, Y) to FT3 (X, Y) for the X direction and the Y direction are plotted according to the illumination regions such that the PWM values (for example, 4095) are made to correspond to the illumination regions of the individual LEDs.

In FIGS. 4, 7 and 10, as in FIG. 2, the filter values of the filter FT (X, Y) for the X direction and the Y direction are plotted according to the illumination regions SA such that the PWM values (for example, 4095) are made to correspond to the illumination regions SA of the individual LEDs 52. FIG. 13 is an illustration diagram in which the filter values of all the filters FT (X, Y), that is, the filters FT1 (X, Y) to FT3 (X, Y), are shown together.

As will be understood from the filter values of the filter FT (X) for the X direction of FIG. 13, in all the filters FT (X), filter values around the ends in the X direction are lower than those around the center (in other words, the filter values around the center in the X direction are higher than those around the ends). Hence, these filter values are arranged in the same order as the illumination regions SA in the X direction, with the result that a mountain-shaped graph is completed.

Likewise, as will be understood from the filter values of the filter FT (Y) for the Y direction of FIG. 13, in all the filters FT (Y), filter values around the ends in the Y direction are lower than those around the center. Hence, these filter values are arranged in the same order as the illumination regions SA in the Y direction, with the result that a mountain-shaped graph is completed.

Figure 8:
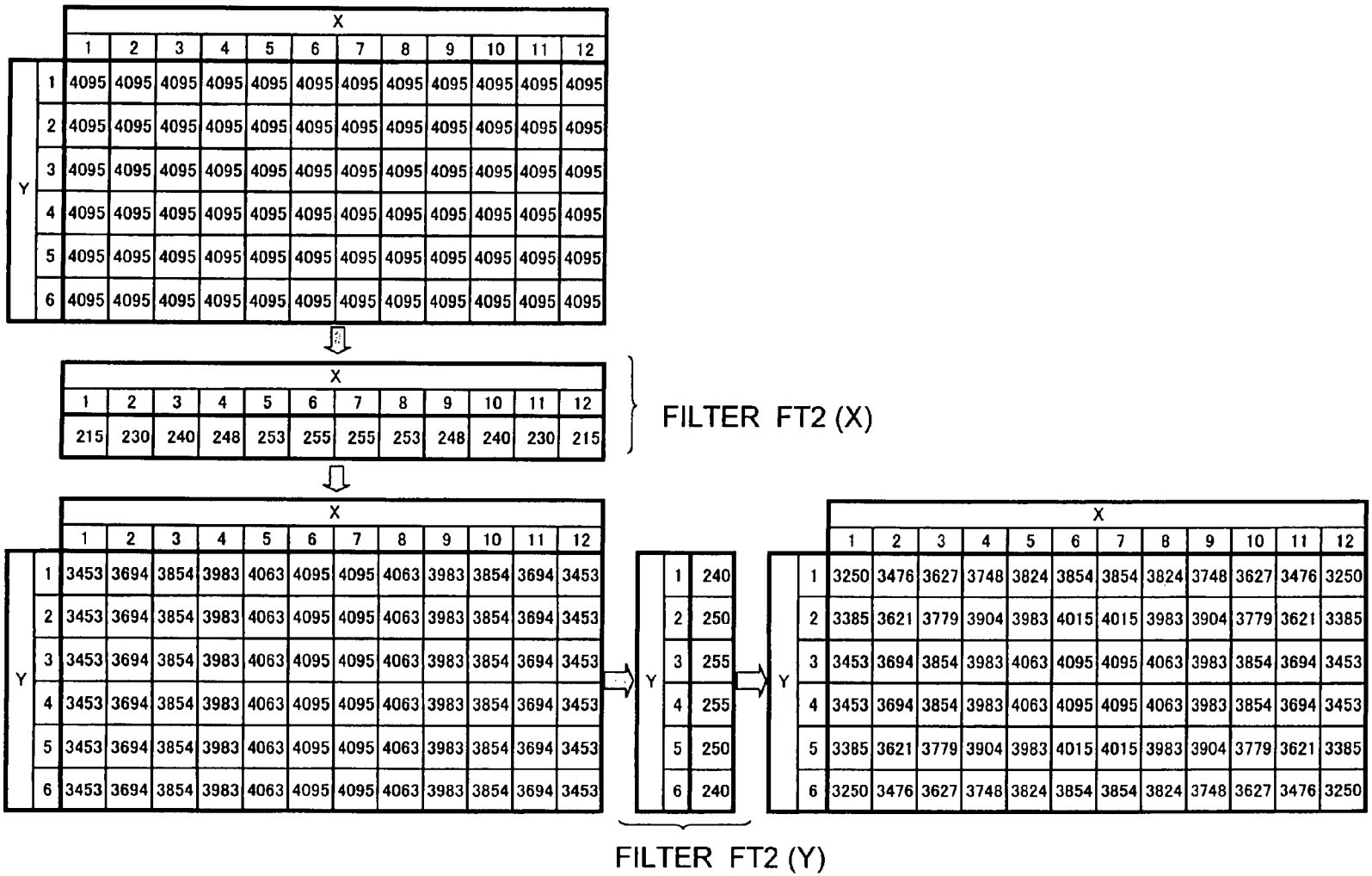
FIG. 8 An illustration diagram showing how the LEDs that emit light with the PWM value of 4095 are subjected to the brightness correction processing using the filter FT2 (X) for the X direction and then the LEDs are further subjected to the brightness correction processing using the filter FT2 (Y) for the Y direction.
Figure 11:
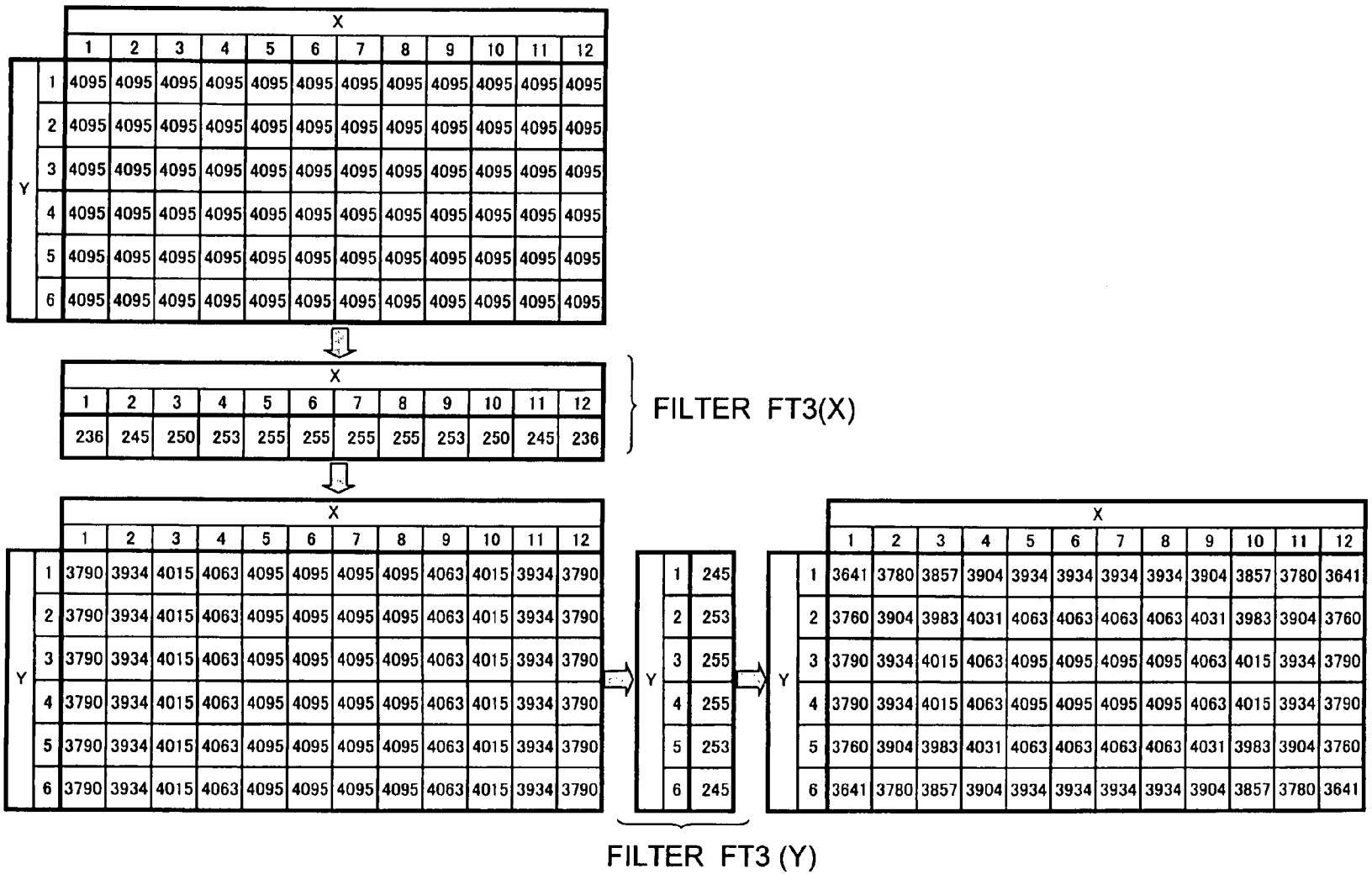
FIG. 11 An illustration diagram showing how the LEDs that emit light with the PWM value of 4095 are subjected to the brightness correction processing using the filter FT3 (X) for the X direction and then the LEDs are further subjected to the brightness correction processing using the filter FT3 (Y) for the Y direction.

FIGS. 5, 8 and 11 show how the LEDs 52 that emit light with the PWM value of 4095 are subjected to the brightness correction processing using the filter FT (X) for the X direction and the LEDs 52 are further subjected to the brightness correction processing using the filter FT (Y) for the Y direction (the correction processing proceeds along arrows).

Figure 9:
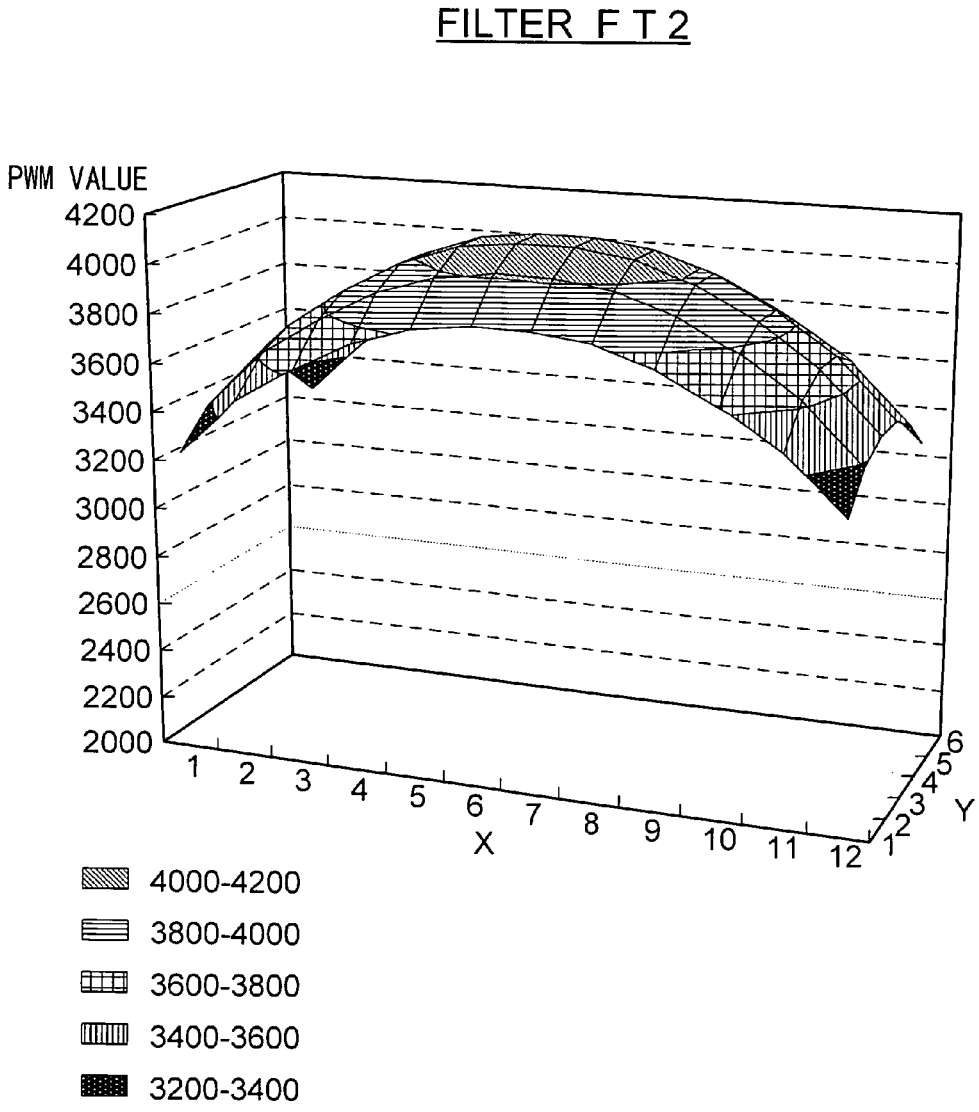
FIG. 9 A contour line diagram showing, in a contour manner, PWM values resulting from the brightness correction processing corresponding to the X direction and the Y direction using the filter FT2 (X, Y) and the illumination regions.
Figure 12:
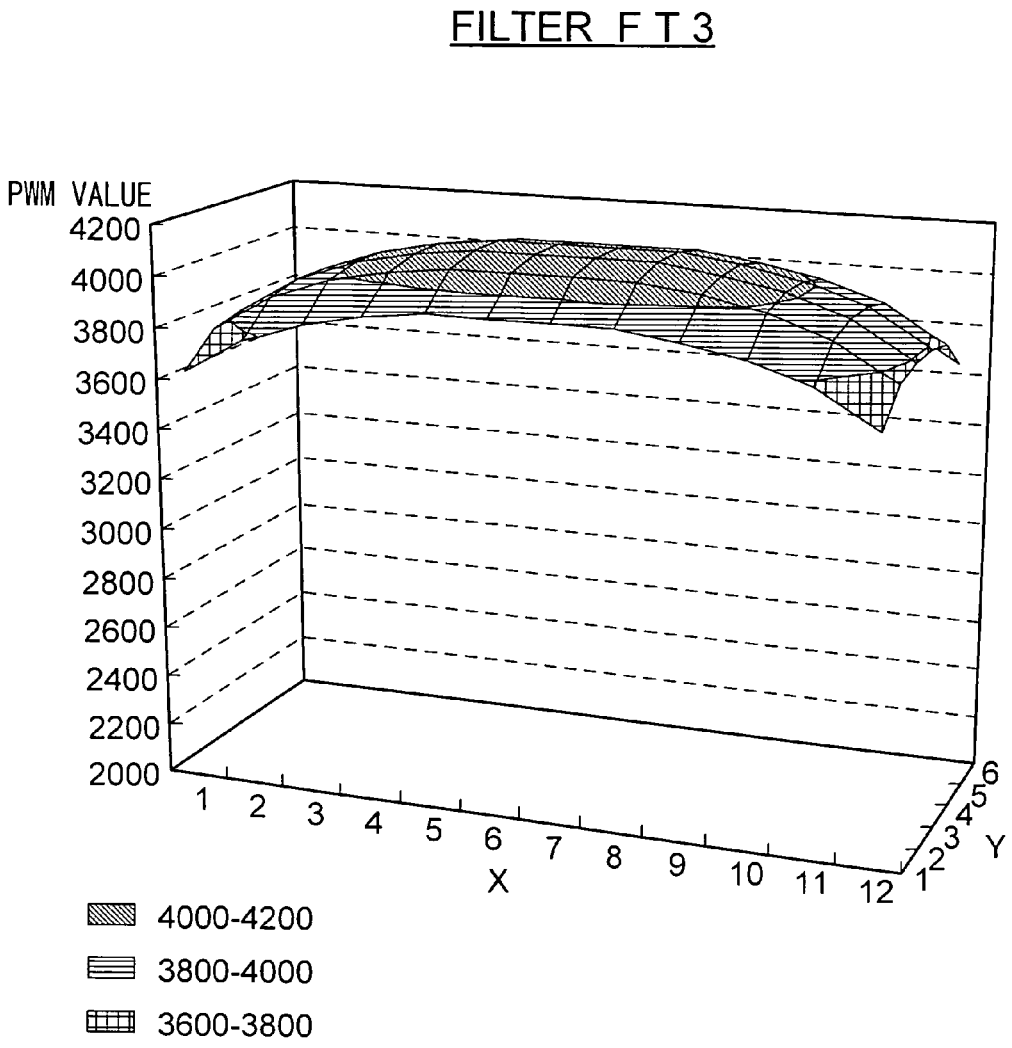
FIG. 12 A contour line diagram showing, in a contour manner, PWM values resulting from the brightness correction processing corresponding to the X direction and the Y direction using the filter FT3 (X, Y) and the illumination regions.

FIGS. 6, 9 and 12 show, in a contour manner, the PWM values (that is, the light source color video signals (RSd', GSd' and BSd')) resulting from the brightness correction processing corresponding to the X direction and the Y direction shown in FIGS. 4, 7 and 10 and the illumination regions SA.

With reference to the drawings described above, a description will be given. As shown in FIGS. 5, 8 and 11, the brightness correction portion 21 uses the filter FX (X) to perform the brightness correction processing on the PWM values (the light source color video signals RSd, GSd and BSd) that are transmitted from the aging degradation correction portion 36 and that have not been subjected to the brightness correction processing. Specifically, the brightness correction processing is performed according to the following equation:

the *PWM* values before the brightness correction processing×the filter values of the filter *FT*(*X*)/255=the *PWM* values resulting from the brightness correction processing for the *X* direction Then, after the brightness correction processing for the X direction, the brightness correction portion 21 performs the brightness correction processing for the Y direction. Specifically, the brightness correction processing is performed according to the following equation:

the *PWM* values resulting from the brightness correction processing using the filter *FT*(*X*)×the filter values of the filter *FT*(*Y*)/255=the *PWM* values resulting from the brightness correction processing for the *X* direction and the *Y* direction A specific example will be described below. For example, when the brightness correction portion 21 uses the filter FT1 (X, Y) [brightness correction (high) type] shown in FIG. 5, the PWM value of "4095" in the illumination region SA in the first row and the first column of the matrix arrangement is subjected to the following brightness correction processing using a filter value of "200" in the first row of the filter FT1 (X) (see a PWM value resulting from the brightness correction processing indicated by an arrow from the filter FT1 (X)).

$$4095\times200/255\approx3212$$

Furthermore, the PWM value of "3212" that is arranged in the illumination region SA in the first row and the first column of the matrix arrangement and that results from the brightness correction processing for the X direction is subjected to the following brightness correction processing using a filter value of "230" in the first column of the filter FT1 (Y) (see a PWM value resulting from the brightness correction processing indicated by an arrow from the filter FT1 (Y)).

$$3212\times230/255\approx2897$$

FIGS. 6, 9 and 12 are figures that show, in a contour manner, the results of the above brightness correction processing for the X direction and the Y direction which has been performed for each of the illumination regions SA. Here, FIGS. 6, 9 and 12 are compared with FIG. 3 that shows, in a contour manner, the illumination regions SA and the PWM values on which the brightness correction processing has not been performed.

The brightness of the illumination region SA around the center of the entire illumination region SAgr after the brightness correction processing is substantially the same between that FIGS. 6, 8 and 12 and FIG. 3. On the other hand, the brightness of the illumination regions SA in the outer edge of the entire illumination region SAgr after the brightness correction processing shown in FIGS. 6, 8 and 12 is lower than that shown in FIG. 3.

In other words, when the brightness correction processing is performed using the filter FT (X, Y) composed of the filter values in which the filter values around the ends are lower than the filter value around the center in each of the directions (two directions, that is, the X direction and the Y direction), the distribution of brightness is achieved in which the brightness of the illumination regions SA in the outer edge of the entire illumination region SAgr is lower than that of the illumination region SA around the center (in the case of the LED 52 including the LED chips 53R, 53G and 53B, uneven color is also eliminated).

What has discussed above will be summarized below. Under control by the main microcomputer 12, the brightness correction portion 21 of the LED controller 13 receives the light source color video signals (RSd, GSd and BSd) based on the basic color video signals (as shown in FIG. 1, the light source color video signals may be subjected to correction processing other than the brightness correction processing performed by the individual unevenness correction portion 33, the temperature correction portion 35 and the aging degradation correction portion 36).

Then, under control by the main microcomputer 12, along at least two directions (for example, the X direction and the Y direction) within the plane of the planar light formed by the LEDs 52 arranged in a matrix, the LED controller 13 (that is, the microcomputer unit 11) performs the brightness correction processing for adjusting the brightness distribution of the planar light on the light source color video signals (RSd, GSd and BSd), and converts them into the light source color video signals (RSd', GSd' and BSd').

In this way, for example, when the LEDs 52 corresponding to the entire illumination region SAgr attempt to emit light according to the PWM values of "4095" (the light source color video signals (RSd, GSd and BSd)), the LEDs 52 emit light according to the PWM values (the light source color video signals (RSd', GSd' and BSd')) that correspond to the two directions shown in FIGS. 6, 9 and 12 and that have been subjected to the brightness correction processing.

Since, in particular, the brightness correction processing is performed along the two directions of the X direction and the Y direction, the brightness correction processing is two-dimensionally performed on the planar light. Hence, the shape of the brightness distribution of the planar light greatly varies as compared with, for example, planar light on which the brightness correction processing is one-dimensionally performed (along only one direction). One example thereof is the brightness distribution shown in FIGS. 6, 9, 12 or the like.

The brightness correction processing is performed by the microcomputer unit 11 such that, in each of the directions (the X direction and the Y direction), the brightness around the ends of the direction is lower than that around the center. Thus, the brightness around the center of the entire illumination region SAgr is little changed even after the brightness correction processing; the brightness in the outer edge of the entire illumination region SAgr, that is, in the regions other than the vicinity of the center, on which the brightness correction processing has been performed, is lower than the brightness before the brightness correction processing.

Even if the brightness in the outer edge of the entire illumination region SAgr is relatively low, the brightness around the center of the entire illumination region SAgr is sufficiently high. Hence, due to the human visual characteristic, the entire illumination region SAgr (that is, the planar light) that does not include uneven brightness and that has a constant brightness is perceived by the visually recognizing person.

The LEDs 52 that generate the planar light having the brightness distribution with which the planar light is perceived by the visually recognizing person as if the planar light does not include uneven brightness and with which such uneven brightness is not perceived by the visually recognizing person are reduced in power consumption. In other words, the power consumption of the LEDs 52 on which the brightness correction processing is performed is lower than that of the LEDs 52 on which the brightness correction processing is not performed.

Hence, the backlight unit 69 (and therefore, the liquid crystal display device 89) having the brightness correction processing function described above is driven with low power consumption. The liquid crystal display device 89 incorporating the backlight unit 69 can reduce the power consumption without the image quality being reduced. The microcomputer unit 11 changes the brightness of the LED 52 based on each of the directions (the X direction and the Y direction). Hence, for example, as compared with a microcomputer unit that changes the brightness of its light sources based on the result of analysis of image data on each of the light sources, the microcomputer unit 11 can reduce a burden imposed on control.

Part or all of the reception portion 41, the video signal processing portion 42, the liquid crystal display panel controller 43 and the microcomputer unit 11 (the main microcomputer 12 and the LED controller) shown in FIG. 1 may be incorporated either in the liquid crystal display panel 79 or in the backlight unit 69. In short, these members are preferably incorporated in the liquid crystal display device 89. When the brightness correction control described above is performed only by the backlight unit 69, at least the reception portion 41, the video signal processing portion 42 and the microcomputer unit 11 are incorporated in the backlight unit 69.

As shown in FIG. 13, the shape of the graph of the filter FT (X, Y) is preferably symmetrical with respect to the center of each of the directions (the X direction and the Y direction) (in other words, the filter values for each of the directions preferably have a symmetrical relationship). This is because, in this way, it is possible to reduce the capacity of the filter memory 22 that stores the filter FT.

Although the brightness correction processing described above is performed according to the X direction and the Y direction of the LEDs 52 arranged in a plane, the present invention is not limited to this method. For example, the microcomputer unit 11 (specifically, the brightness correction portion 21) can perform the brightness correction processing according to either only the X direction or only the Y direction.

Although, in the above description, the brightness correction processing for the X direction is first performed, and then the brightness correction processing for the Y direction is performed, the present invention is not limited to this order. The order may be reversed. The brightness correction processing may be performed along another direction other than the X direction and the Y direction or two or more directions.

Second Embodiment

A second embodiment will be described. Members having the same functions as the members used in the first embodiment are identified with common symbols, and their description will not be repeated. In the present embodiment, a description will be given of: a case where the brightness correction processing is not performed; and with what parameter any one of a plurality of filters FT (X, Y) is selected when the brightness correction processing is performed.

As described in the first embodiment, there are a plurality of filters FT (X, Y) such as the filter FT1 (X, Y) [brightness correction (high) type], the filter FT2 (X, Y) [brightness correction (medium) type] and the filter FT3 (X, Y) [brightness correction (low) type]. However, the brightness correction processing is not necessarily performed by the brightness correction portion 21 (and therefore the microcomputer unit 11). For example, on the liquid crystal display panel 79, the basic video signal that is image data is displayed as an image; it may be unnecessary to perform the brightness correction processing depending on the display format (display mode) of the image.

For example, when the liquid crystal display device 89 connected to a personal computer displays image data of the personal computer on the liquid crystal display panel 79, relatively high uniformity (the uniformity of brightness) of the displayed image is required. For example, when the liquid crystal display device 89 that is incorporated in a liquid crystal television set displays a still image on the liquid crystal display panel 79, relatively high uniformity of the displayed image is also required.

Hence, when such a display mode, that is, a PC image display mode in which the image of the personal computer (PC) is displayed or a still image display mode in which a still image is displayed, is used, the liquid crystal display device 89 (or the backlight unit 69) does not perform the brightness correction processing. Then, since the brightness correction processing is not performed, for example, as shown in FIG. 3, all the LEDs 52 that emit light according to the PWM values of "4095" form the entire illumination region SAgr (planar light). Therefore, the uniformity of an image displayed on the liquid crystal display panel 79 as a result of the planar light being received is reliably improved.

As the display mode in which the basic video signal (specifically, that can also be considered to be the processing color video signal (RSp, GSp or BSp) transmitted to the liquid crystal display panel controller 43) that is image data is displayed, various types of modes are available. The microcomputer unit 11 performs control on what display mode is set.

Specifically, the main microcomputer 12 transmits to the brightness correction portion 21 of the LED controller 13 the display mode that is set. Then, the brightness correction portion 21 selects the filter FT (X, Y) corresponding to the set display mode, and uses this filter FT (X, Y) to perform the brightness correction processing (as described above, the brightness correction portion 21 may naturally make a selection so as not to perform the brightness correction processing).

For example, when the liquid crystal display device 89 that is incorporated in a liquid crystal television set can set a dynamic display mode in which an image having a high brightness is displayed, the brightness correction portion 21 selects the filter FT3 (X, Y) [brightness correction (low) type] corresponding to the dynamic display mode, and performs the brightness correction processing.

In this way, although, as shown in FIG. 12, the brightness of the illumination regions SA in the outer edge of the entire illumination region SAgr is slightly lower than that of the illumination region SA around the center, the brightness of the entire illumination region SAgr as a whole is kept relatively high. Hence, the liquid crystal display device 89 including the backlight unit 69 that generates the planar light of the entire illumination region SAgr as described above can provide an image corresponding to a display mode desired by the visually recognizing person and can simultaneously reduce the power consumption.

When the liquid crystal display device 89 that is incorporated in a liquid crystal television set can set a standard display mode in which an image having a standard brightness is displayed, the brightness correction portion 21 selects the filter FT1 (X, Y) [brightness correction (high) type] corresponding to the standard display mode, and performs the brightness correction processing.

In this way, as shown in FIG. 6, the brightness of the illumination regions SA in the outer edge of the entire illumination region SAgr is much lower than that of the illumination region SA around the center (the gradient of brightness is steep). However, in the standard display mode, an excessive brightness is not required, and the illumination region SA around the center of the entire illumination region SAgr has a relatively high brightness. Hence, the visually recognizing person does not determine that the planar light corresponding to the standard display mode includes uneven brightness.

Consequently, the liquid crystal display device 89 described above can provide an image corresponding to a display mode desired by the visually recognizing person and can simultaneously reduce a large amount of power (when the filter FT1 (X, Y) is used, the largest amount of consumed power is reduced as compared with a case where another filter, that is, the filter FT2 (X, Y) or the filter FT3 (X, Y), is used.

In view of the foregoing, the microcomputer unit 11 included in the backlight unit 69 (and therefore the liquid crystal display device 89) changes the brightness correction processing according to the display mode of the image data (such as the PC display mode, the still image display mode, the dynamic display mode or the standard display mode). Thus, it is possible not only to acquire a brightness suitable for the display mode but also to reduce power consumption according to the display mode (in the case of the LED 52 including the LED chips 53R, 53G and 53B, uneven color is also eliminated).

Third Embodiment

A third embodiment will be described. Members having the same functions as the members used in the first and second embodiments are identified with common symbols, and their description will not be repeated. In the present embodiment, a description will be given of which one of a plurality of filters FT (X, Y) is selected with a parameter other than the display mode.

One of the functions included in the main microcomputer 12 of the microcomputer unit 11 is the function of detecting an average picture level (APL). This APL detection function is to determine the average value (APL value) of gradation of an image displayed on the liquid crystal display panel 79. For example, as shown in FIG. 1, the main microcomputer 12 receives the panel processing color video signals (RSp, GSp and BSp) and the synchronization signals related to these signals, and thereby specifies an image displayed in one frame period and calculates the APL value of gradation of the image.

For example, when a white image is displayed on the liquid crystal display panel 79, the APL value (brightness level) is 100% whereas, when a black image is displayed on the liquid crystal display panel 79, the APL value is 0%. Hence, the microcomputer unit 11 may perform the brightness correction processing according to the APL value.

For example, when the APL value is equal to or more than 75% but equal to or less than 100%, and a whitish image having a high brightness or the like is displayed on the liquid crystal display panel 79, the microcomputer unit 11 (specifically the brightness correction portion 21) preferably performs the brightness correction processing using the FT1 (X, Y) [brightness correction (high) type].

When this brightness correction processing is performed, since, as shown in FIG. 6, the illumination region SA around the center of the entire illumination region SAgr has a relatively high brightness, the visually recognizing person does not determine that the entire illumination region SAgr includes uneven brightness. On the other hand, since the brightness of the illumination regions SA in the outer edge of the entire illumination region SAgr is much lower than that of the illumination region SA around the center, it is possible to reduce a large amount of consumed power. In other words, when the liquid crystal display device 89 performs this brightness correction processing, it is possible not only to display an image according to the magnitude of the APL value but also to reduce power consumption.

By contrast, when the APL value is equal to or more than 0% but less than 25%, and a blackish image having a low brightness or the like is displayed on the liquid crystal display panel 79, the microcomputer unit 11 does not perform the brightness correction processing using the filter FT (X, Y). That is because, when a blackish image is displayed on the liquid crystal display panel 79, not all of the LEDs 52 of the backlight unit 69 need to emit light having a high brightness, and this reduces the need for preventing uneven brightness and the need for reducing the power consumption.

What has been described above will be expressed in another way below. For example, when, as a blackish image having a low brightness, an image of a night sky where a plurality of stars are shining to have the same brightness is displayed on the liquid crystal display panel 79, if the brightness correction processing is performed, differences in brightness between the starts are produced, with the result that the starts stand out against the night sky (in short, the visually recognizing person feels the degraded quality of the image).

However, when the brightness correction processing is not performed, all the stars are shining to have the same brightness, and thus the visually recognizing person can visually recognize the beautiful night sky. In other words, when the APL value is equal to or more than 0% but less than 25%, and a blackish image having a low brightness or the like is displayed on the liquid crystal display panel 79, the microcomputer unit 11 prioritizes the quality of the image displayed on the liquid crystal display panel 79.

When the APL value falls within a range between the range of the APL value equal to or more than 0% but less than 25% and the range of the APL value equal to or more than 75% but equal to or less than 100%, that is, the APL value is equal to or more than 25% but less than 75%, the microcomputer unit 11 preferably performs the brightness correction processing using the filter FT3 (X, Y) [brightness correction (low) type] or the filter FT2 (X, Y) [brightness correction (medium) type] that has a lower brightness correction level than the filter FT1 (X, Y).

For example, when the APL value is equal to or more than 25% but less than 50%, and an image slightly brighter than black or the like is displayed on the liquid crystal display panel 79, the microcomputer unit 11 preferably performs the brightness correction processing using the filter FT3 (X, Y) [brightness correction (low) type]. When the APL value is equal to or more than 50% but less than 75%, and an image slightly darker than white or the like is displayed on the liquid crystal display panel 79, the microcomputer unit 11 preferably performs the brightness correction processing using the filter FT2 (X, Y) [brightness correction (medium) type].

In view of the foregoing, the microcomputer unit 11 included in the backlight unit 69 (and therefore the liquid crystal display device 89) changes the brightness correction processing according to the APL value. Thus, it is possible not only to have the planar light having a brightness suitable for the APL value but also to reduce power consumption according to the APL value (in the case of the LED 52 including the LED chips 53R, 53G and 53B, uneven color is also eliminated).

As a frame image changes with time, the APL value likewise changes with time. The APL value may be suddenly changed from 100% to 15%. In this case, when the APL value is 100%, the brightness correction processing using the filter FT1 (X, Y) [brightness correction (high) type] is performed whereas, when the APL value is 15%, the brightness correction processing is not performed. However, even when the brightness correction processing using the filter FT1 (X, Y) is suddenly stopped, flicker due to the change of the brightness is visually recognized.

In order to prevent the flicker, when levels of the brightness correction processing are stepwise set, the brightness correction processing is performed in the stepwise order of the levels. For example, with reference to FIG. 14 in which the horizontal axis represents the APL value to which the filters FT1 (X, Y) to FT3 (X, Y) and the lack of the brightness correction processing (FILTER OFF) correspond and the vertical axis represents the level (LEVEL) of the brightness correction processing of the filters FT1 (X, Y) to FT3 (X, Y), a description will be given.

Figure 14:
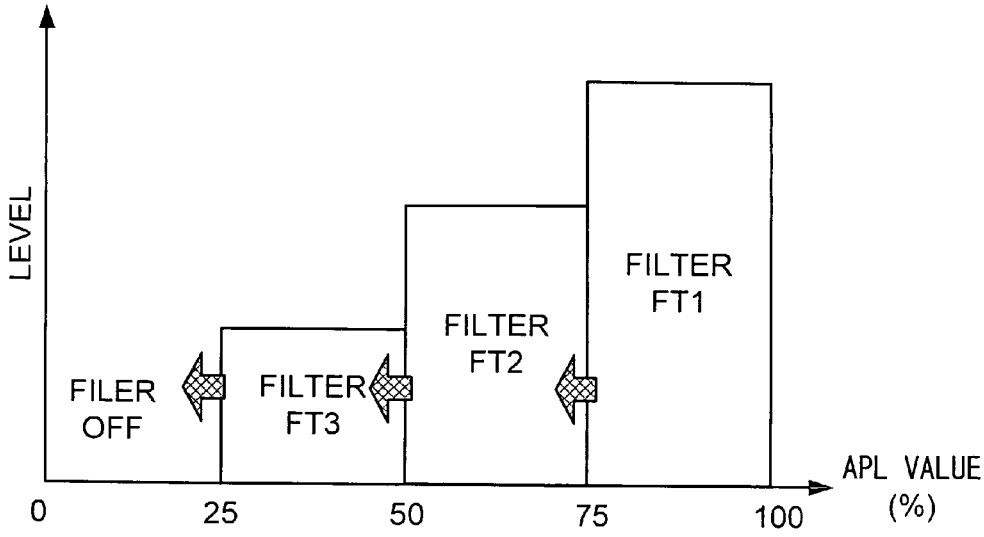
FIG. 14 An illustration diagram in which the horizontal axis represents the APL value to which the filters FT1 (X, Y) to FT3 (X, Y) and the lack of the brightness correction processing (FILTER OFF) are made to correspond and the vertical axis represents the level (LEVEL) of the brightness correction processing of the filters FT1 (X, Y) to FT3 (X, Y)

When the APL value is changed from 100% to 15%, the microcomputer unit 11 does not suddenly stop the brightness correction processing using the filter FT1 (X, Y) [brightness correction (high) type] (the horizontal axis in FIG. 14 also represents the level of reduction of the power consumption). Specifically, the microcomputer unit 11 performs the brightness correction processing using the filter FT1 (X, Y), then performs the brightness correction processing using the filter FT2 (X, Y) [brightness correction (medium) type], further performs the brightness correction processing using the filter FT3 (X, Y) [brightness correction (low) type] and thereafter stops the brightness correction processing (see shaded arrows in FIG. 14).

In other words, when the APL value is changed from a certain value (for example, 100%) to another value (for example, 15%), if there is an intermediate brightness correction processing level between the brightness correction processing level corresponding to the certain value and the brightness correction processing level corresponding to the another value, the microcomputer unit 11 stepwise changes the levels through the intermediate brightness correction processing level to perform the brightness correction processing (the stepwise change of the brightness correction processing in the opposite direction to that of the arrows of FIG. 14 is also expected).

Hence, even when the brightness correction processing is performed according to the sudden change of the APL value, the brightness is not changed due to such brightness correction processing. Therefore, the liquid crystal display device 89 incorporating the backlight unit 69 having the brightness correction processing function described above can provide an image of high quality.

Fourth Embodiment

A fourth embodiment will be described. Members having the same functions as the members used in the first to third embodiments are identified with common symbols, and their description will not be repeated. In the present embodiment, a description will be given of which one of a plurality of filters FT (X, Y) is selected with a parameter other than the display mode and the APL value.

In general, the LED 52 has the property of decreasing the brightness due to the influence of the heat of its light emission and the influence of outside air whose temperature is increased by the heat of the light emission. When the LEDs 52 are arranged in a matrix in the backlight unit 69 of the liquid crystal display device 89, the LEDs 52 around the center, in particular, are more likely to be reduced in brightness due to the temperature influence.

This is because: due to the structure of the backlight unit 69, heated air is unlikely to be dissipated from the vicinity of the LEDs 52 around the center of the matrix; and moreover, various electronic parts are arranged around the LEDs 52, and the air of high temperature heated by the driving of the electronic parts further increases the temperature of the LEDs 52.

Hence, the thermistors 55 for measuring the temperature of the LEDs 52 are attached to the backlight unit 69, and the temperature correction portion 35 of the LED controller 13 uses the temperature measured by the thermistors 55 to correct the brightness change of the LEDs 52 caused by the temperature. Specifically, the temperature correction portion 35 reduces the brightness of light emitted by the LEDs 52 according to the temperature of the LEDs 52 (by the feedback of the temperature), and thereby reduces the uneven brightness and the uneven color of the planar light. Therefore, the microcomputer unit 11 may perform the brightness correction processing corresponding to the temperature of the LEDs 52.

For example, when the temperature of the LEDs 52 is increased to fall within a range of 55° C. or more but about 70° C. or less, the microcomputer unit 11 (specifically, the brightness correction portion 21) preferably performs the brightness correction processing using the FT1 (X, Y) [brightness correction (high) type].

When this brightness correction processing is performed, the brightness of the LEDs 52 around the center of the matrix, that is, the brightness of the illumination region SA around the center of the entire illumination region SAgr, is reduced by the feedback of the temperature, and the brightness of the illumination regions SA in the outer edge of the entire illumination region SAgr is also reduced accordingly (see FIG. 6).

In other words, even if the brightness of the illumination region SA around the center of the entire illumination region SAgr is reduced by the feedback of the temperature, the brightness correction processing is performed to reduce the brightness of the entire illumination region SAgr, with the result that uneven brightness is not included in the planar light. Moreover, the brightness of the illumination regions SA in the outer edge of the entire illumination region SAgr is reduced, and thus the power consumption is reduced.

By contrast, when the temperature of the LEDs 52 is equal to or more than 0° C. but less than 40° C., the microcomputer unit 11 performs the brightness correction processing using not the FT1 (X, Y) but FT3 (X, Y) [brightness correction (low) type].

In general, when the temperature of the LEDs 52 is equal to or more than 0° C. but less than 40° C., since the LEDs 52 around the center of the matrix are not heated excessively, the brightness of the LEDs 52 is only slightly reduced. Hence, when the brightness correction processing using the filter FT1 (X, Y) is performed, even though the brightness of the illumination region SA around the center of the entire illumination region SAgr is slightly reduced, the brightness of the illumination regions SA in the outer edge of the entire illumination region SAgr is reduced. In other words, uneven brightness is included in the planar light.

Hence, the microcomputer unit 11 performs the brightness correction processing using the filter FT3 (X, Y) [brightness correction (low) type] with which the brightness of the illumination regions SA in the outer edge of the entire illumination region SAgr is not reduced excessively. Thus, the brightness of the illumination regions SA in the outer edge is reduced without the brightness of the entire illumination region SAgr being reduced excessively, with the result that the power consumption is reduced (see FIG. 12).

When the temperature of the LEDs 52 falls within the temperature range between the temperature range equal to or more than 0° C. but less than 40° C. and the temperature range equal to or more than 55° C. but equal to or less than about 70° C., that is, the temperature of the LEDs 52 is equal to or more than 40° C. but less than 55° C., the microcomputer unit 11 preferably performs the brightness correction processing using the filter FT2 (X, Y) [brightness correction (medium) type] that has an intermediate brightness correction level between the filter FT1 (X, Y) and the filter FT3 (X, Y).

In view of the foregoing, the microcomputer unit 11 included in the backlight unit 69 (and therefore the liquid crystal display device 89) changes the brightness correction processing according to the temperature of the LEDs 52. Thus, it is possible not only to acquire a brightness suitable for the influence of the temperature of the LEDs 52 but also to reduce power consumption according to the influence of the temperature of the LEDs 52 (in the case of the LED 52 including the LED chips 53R, 53G and 53B, uneven color is also eliminated).

In the above description, the LED controller 13 acquires, through the temperature correction portion 35, data on the temperature (the temperature of the LEDs 52) measured by the thermistor 55. Hence, the brightness correction processing depending on the temperature of the LEDs 52 may be performed by the brightness correction portion 21 under management by the LED controller 13 itself (naturally, the brightness correction processing depending on the temperature of the LEDs 52 may be performed by the brightness correction portion 21 under management by the main microcomputer 12).

Incidentally, the temperature of the LEDs 52 is changed depending on the state of the LEDs 52 that are being driven. For example, when the LEDs 52 that emit light for a predetermined time period based on a predetermined amount of current are used, the temperature of the LEDs 52 is gradually increased with time (for example, the temperature of the LEDs 52 is gradually increased from about 25° C., which is called a room temperature, to about 70° C.).

Hence, when levels of the brightness correction processing are stepwise set, the brightness correction processing is performed in the stepwise order of the levels. For example, with reference to FIG. 15 in which the horizontal axis represents the temperature of the LEDs 52 to which the filters FT1 (X, Y) to FT3 (X, Y) correspond and the vertical axis represents the level (LEVEL) of the brightness correction processing of the filters FT1 (X, Y) to FT3 (X, Y), a description will be given.

Figure 15:
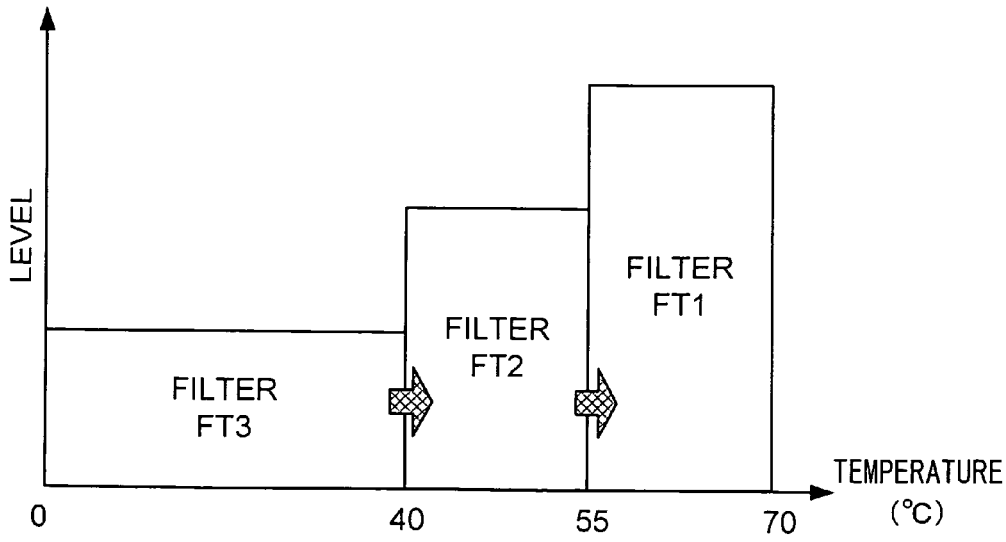
FIG. 15 An illustration diagram in which the horizontal axis represents the temperature of the LEDs to which the filters FT1 (X, Y) to FT3 (X, Y) are made to correspond and the vertical axis represents the level (LEVEL) of the brightness correction processing of the filters FT1 (X, Y) to FT3 (X, Y)

In FIG. 15, while the temperature is in the process of being changed from about 25° C. to about 70° C., the microcomputer unit 11 performs the brightness correction processing using filter FT3 (X, Y) [brightness correction (low) type], further performs the correction processing using the filter FT2 (X, Y) [brightness correction (medium) type] and thereafter performs the brightness correction processing using the filter FT1 (X, Y) [brightness correction (high) type] (see shaded arrows in FIG. 15).

In other words, when the temperature of the LEDs 52 is changed from a certain temperature (for example, about 25° C.) to another temperature (for example, about 70° C.), if there is an intermediate brightness correction processing level between the brightness correction processing level corresponding to the certain temperature and the brightness correction processing level corresponding to the another temperature, the microcomputer unit 11 stepwise changes the levels through the intermediate brightness correction processing level to perform the brightness correction processing (the stepwise change of the brightness correction processing in the opposite direction to that of the arrows of FIG. 15 is also expected).

Hence, even when the brightness correction processing is performed according to the temperature change of the LEDs 52, the brightness is not changed due to such brightness correction processing. Therefore, the liquid crystal display device 89 incorporating the backlight unit 69 having the brightness correction processing function described above can provide an image of high quality.

Other Embodiments

The present invention is not limited to the embodiments described above; many modifications are possible without departing from the spirit of the present invention.

For example, in the above description, for convenience of the figures, the PWM values shown in the figures are an example of the PWM values of one of the LED chips 53; for convenience, in the above description, the PWM values corresponding to the remaining LED chips 53 are assumed to be the same as the values shown in the figures. However, naturally, the LED chips 53R, 53G and 53B may differ in the PWM values from each other.

As shown in FIG. 1, the filters FT (X, Y) [FT R-(X), FT G-(X), FT B-(X), FT R-(Y), FT G-(Y) and FT B-(Y)] differ for each of the LED chips 53R, 53G and 53B. Hence, the microcomputer unit 11 performs the different type of brightness correction processing for each of the colors, and thus it is possible to reduce not only the brightness correction processing but also uneven color.

Moreover, for each of the parameters (such as the display mode, the APL value and the temperature of the LEDs 52), the filters FT (X, Y) may differ from each other; furthermore, the filters FT that differ for each of the parameters may differ for each of the LED chips 53R, 53G and 53B. Thus, it is possible to perform high-quality brightness correction and uneven color correction.

Figure 16:
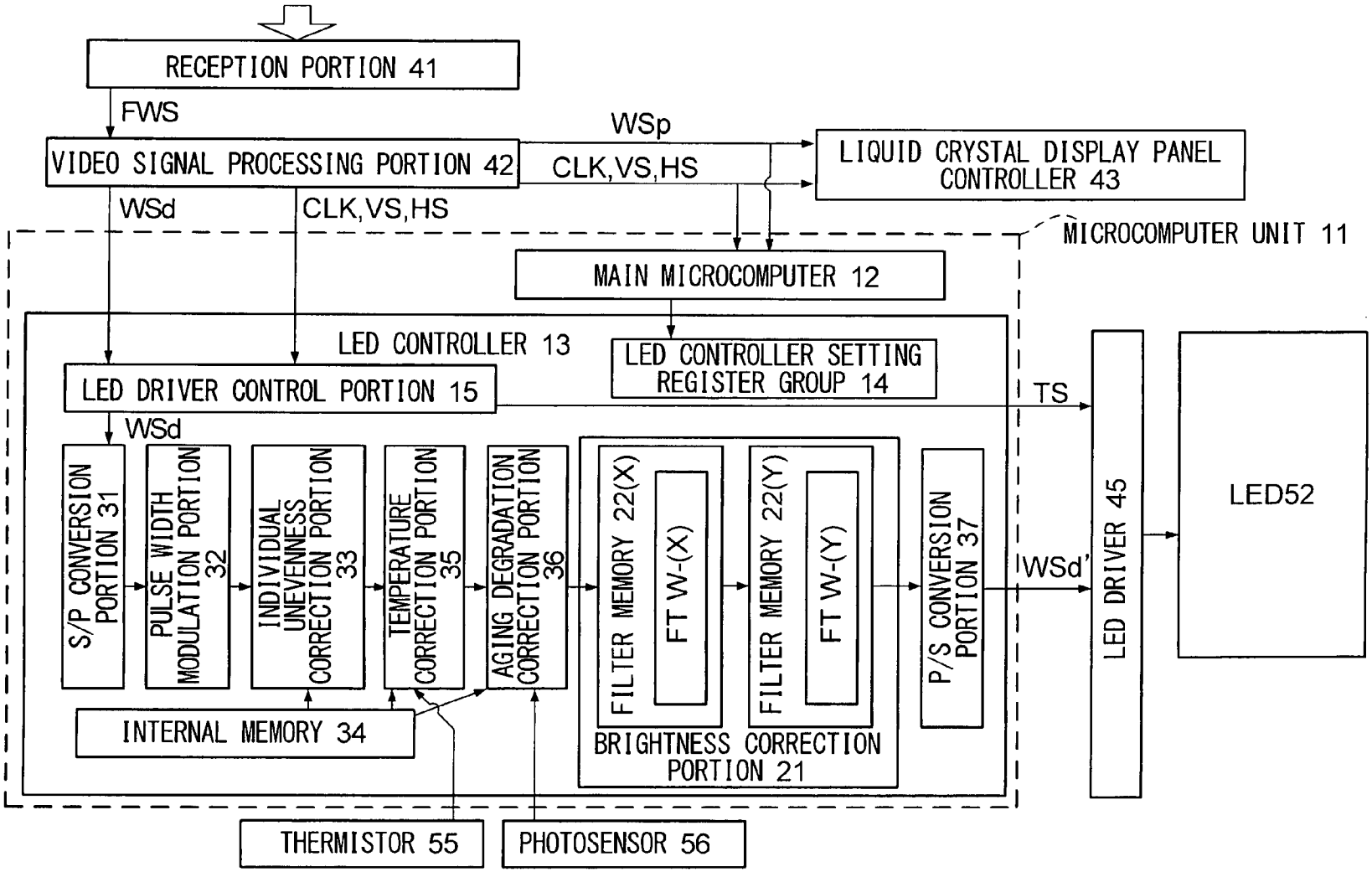
FIG. 16 A block diagram showing various members included in the liquid crystal display device.

By contrast, when the LEDs 52 emit white light in a manner other than the mixture of colors, as shown in FIG. 16, the brightness correction portion 21 preferably performs the brightness correction processing using filters FT-W (X, Y) [FT W-(X) and FT W-(Y)] corresponding to only the white light. In other words, when the LEDs 52 are a light source that emits light of a single color (white) in a manner other than the mixture of colors, the microcomputer unit 11 preferably performs the brightness correction processing corresponding to the single color.

In this way, a burden imposed on control performed by the microcomputer unit 11 is relatively reduced. The filters FT-W (X, Y) may differ for each of the parameters (such as the display mode, the APL value and the temperature of the LEDs 52).

Various signals (FWS, WSp, WSd and WSd') shown in FIG. 18 are as follows.

FRS: a basic white video signal that is a color video signal included in the basic video signal and that indicates white WSp: a processing color video signal WS (panel processing white video signal) that is obtained by processing the basic white video signal and that is transmitted to the liquid crystal display panel controller 43

WSd: a processing color video signal WS (light source white video signal) that is obtained by processing the basic white video signal and that is transmitted to the LED controller 13

WSd': a light source white video signal that has been subjected to the brightness correction processing The basic white video signal FWS, the panel processing white video signal WSp and the light source white video signal WSd have the following relationship:

the basic white video signal *FWS*=the panel processing white video signal *WSp*×the light source white video signal *WSd*

The setting of the parameter in the backlight unit 69 (and therefore the liquid crystal display device 89) may be performed either automatically by the microcomputer unit 11 or manually by the user.

Figure 17:
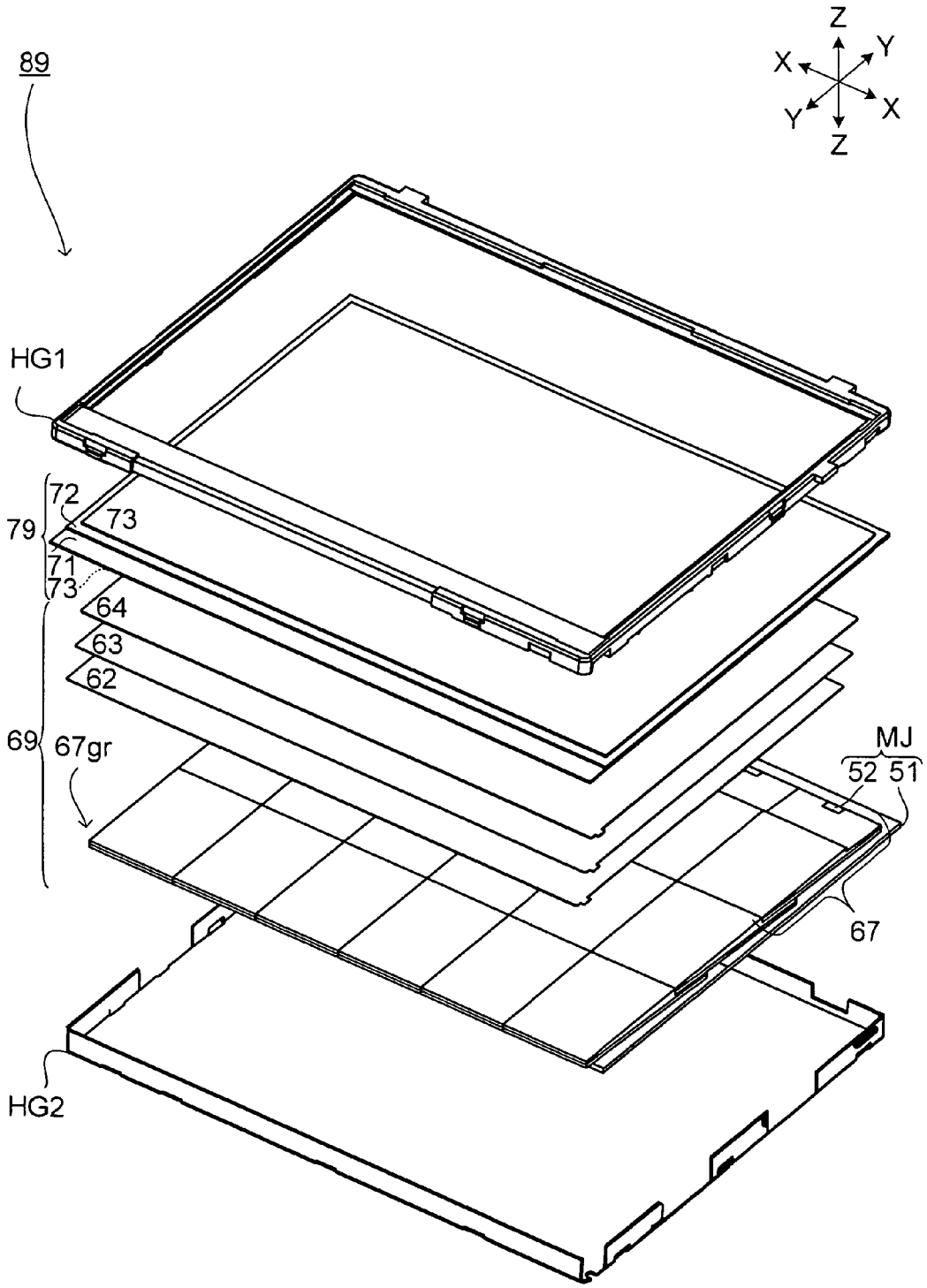
FIG. 17 An exploded perspective view showing a liquid crystal display device.

In the above description, an example of a so-called direct type backlight unit 69 is used. However, the present invention is not limited to this type of backlight unit. For example, as shown in FIG. 17, a backlight unit (tandem type backlight unit) 69 that incorporates a tandem type light guide plate 67*gr* formed by arranging wedge-shaped light guide portions 67 throughout may be used instead.

This is because, even if this type of backlight unit 69 is used, since it is possible to control emitted light for each of the light guide portions 67, the display area of the liquid crystal display panel 79 can be partly illuminated. In other words, this is because this type of backlight unit 69 is also the backlight unit 69 of an active area method.

In the above description, the reception portion 41 receives the video sound signal such as a television broadcast signal, and the video signal of such a signal is processed by the video signal processing portion 42. Hence, a reception device incorporating this type of liquid crystal display device 89 is considered to be a television broadcast reception device (a so-called liquid crystal television set). However, the video signal that is processed by the liquid crystal display device 89 is not limited to television broadcast. For example, the video signal may be either a video signal that is included in a recording medium in which the contents of a movie or the like are recorded or a video signal that is transmitted through the Internet.

Various types of correction processing including the brightness correction processing performed by the microcomputer unit 11 are realized by data generation programs. The data generation programs can be executed by a computer, and may be recorded in a computer readable recording medium. This is because the programs recorded in the recording medium are freely carried.

Examples of this recording medium include: tapes such as a magnetic tape and a cassette tape that can be separated; discs such as a magnetic disc and an optical disc like a CD-ROM; cards such as an IC card (including a memory card) and an optical card; and semiconductor memories such a flash memory.

The microcomputer unit 11 may acquire the data generation programs by communication through a communication network. Examples of the communication network include the Internet and infrared communication regardless of a wired or wireless network.

LIST OF REFERENCE SYMBOLS

11 Microcomputer unit (control unit)
12 Main microcomputer (part of the control unit)
13 LED controller (part of the control unit)
14 LED controller register group (part of the control unit)
15 LED driver control portion (part of the control unit)
21 Brightness correction portion (part of the control unit)
22 Filter memory (part of the brightness correction portion)
FT Filter
41 Reception portion
42 Video signal processing portion
43 liquid crystal display panel controller
45 LED driver
MJ LED modules
52 LED (light source)
53 LED chip (light emission chip)
55 Thermistor (temperature measurement portion)
56 Photosensor
69 Backlight unit (illumination device)
79 Liquid crystal display panel (display panel)
89 Liquid crystal display device (display device)
SA Illumination region
SAgr Entire illumination region
X One direction within a plane of planar light
Y One direction within a plane of planar light

The invention claimed is:

1. An illumination device comprising:

a plurality of light sources that are arranged in a plane and that emit light according to light amount adjustment data to form planar light; and a control unit that performs correction processing on light source control data based on image data to generate the light amount adjustment data, wherein the control unit is configured to perform brightness correction processing for adjusting distribution of brightness of the planar light on the light source control data along at least two directions within a plane of the planar light so as to generate the light amount adjustment data, the control unit changes the brightness correction processing according to a specific parameter, the specific parameter is a display mode for the image data and when a still image display mode in which a still image is displayed is used, the brightness correction processing is not performed whereas, when a mode in which a moving image is displayed is used, the brightness correction processing is performed in each of the directions such that a brightness around both ends of the direction is lower than a brightness around a center thereof.

2. The illumination device of claim 1, further comprising:

a temperature measurement portion that measures a temperature of one of the light sources, wherein the specific parameter is a result of the measurement by the temperature measurement portion.

3. The illumination device of claim 1, wherein levels of the brightness correction processing are stepwise set, and the control unit performs the brightness correction processing in a stepwise order of the levels.

4. The illumination device of claim 1, wherein each of the light sources includes a plurality of light emission chips and colors of light are mixed to generate white light, and the control unit performs a different type of the brightness correction processing for each of the colors.

5. The illumination device of claim 1, wherein each of the light sources is a light source that emits light of a single color, and the control unit performs the brightness correction processing corresponding to the single color.

6. A display device comprising:

the illumination device of claim 1; and a display panel that displays an image according to the image data.

* * * * *